US006032289A

United States Patent [19]

Villapiano

[11] Patent Number: 6,032,289

[45] Date of Patent: Mar. 7, 2000

[54] SECURITY GARMENTS

[76] Inventor: Susan Villapiano, 5 Oak Tree La., Ocean, N.J. 07712

[21] Appl. No.: 09/026,157

[22] Filed: Feb. 19, 1998

Related U.S. Application Data

[63] Continuation-in-part of application No. 08/744,820, Nov. 6, 1996, which is a continuation-in-part of application No. 08/435,655, May 5, 1995.

[51] Int. Cl.[7] ..... A41B 1/00

[52] U.S. Cl. ..... 2/102; 2/69; 2/114

[58] Field of Search ..... 2/102, 69, 114, 2/115, 113, 108, 104, 106, 105, 48.51, 52, 74.75, 77, 109, 125, 269, 270; 604/174, 179, 345

[56] References Cited

U.S. PATENT DOCUMENTS

| | | | |
|---|---|---|---|
| 4,087,864 | 5/1978 | LaBove et al. . | |
| 4,504,267 | 3/1985 | Parmelee . | |
| 4,531,942 | 7/1985 | Turner . | |
| 4,578,062 | 3/1986 | Schneider . | |
| 4,582,508 | 4/1986 | Pavelka . | |
| 4,666,432 | 5/1987 | McNeish . | |
| 4,793,486 | 12/1988 | Konopka et al. . | |
| 4,799,923 | 1/1989 | Campbell | 604/179 |
| 5,048,122 | 9/1991 | Prieur . | |
| 5,048,512 | 9/1991 | Turner et al. | 604/179 |
| 5,336,195 | 8/1994 | Daneshvar . | |
| 5,755,698 | 5/1998 | Kagan et al. | 604/179 |
| 5,806,096 | 9/1998 | Pennington | 2/80 |
| 5,832,536 | 11/1998 | Kramer | 2/69 |
| 5,879,335 | 2/1999 | Martinez et al. | 604/179 |
| 5,897,519 | 4/1999 | Shesol et al. | 602/79 |

*Primary Examiner*—Gloria M. Hale
*Attorney, Agent, or Firm*—Browdy and Neimark

[57] ABSTRACT

Security garments are provided for retaining catheters and other types of tubing in place. The security garments are in the form of undershirts, brassieres, vests, or sleeves, and include fastening means to retain the catheters and tubing in place without vertical or horizontal movement.

23 Claims, 16 Drawing Sheets

SECURITY GARMENTS

The present application is a continuation in part of application Ser. No. 08/744,820, filed Nov. 6, 1996, which is a continuation in part of application Ser. No. 08/435,655, filed May 5, 1995, the entire contents of each of which are hereby incorporated by reference.

FIELD OF THE INVENTION

The present invention relates to devices for supporting and protecting catheters, feeding tubes, surgical drains, and other types of tubing in place in the body, as well as supporting and retaining in position tubes, wires, and the like on the outside of the body.

BACKGROUND OF THE INVENTION

Catheters which are implanted in the body of a patient for an extended period of time are used for intravenous therapies such as parenteral nutrition, chemotherapy for cancer treatments, bone marrow transplants, intravenous antibiotics, blood products and other fluids, and the like, as well as for blood withdrawal. Heretofore, the externally extending tubing portion of the implanted tubing and the free end, which extended from an exit site on the body, was usually either taped to the body, the cap was taped and pinned to the patient's clothing, or the tubing was wrapped to the patient's body with such materials as tube gauze, burn netting, or elastic bandages (e.g., Ace bandages) to prevent displacement and dislodgement of the tubing and to allow maintenance therein of the proper blood or nutrition levels or to administer medication intravenously. To use the catheter or other tubing, for example, to introduce additional fluid into the body when tape is used to secure the catheter, it is first necessary to remove the tape securing the catheter or other tubing to the body or clothing. This removal of the tape and retaping to the body each time the catheter was to be used, and at least daily to allow the line to be flushed to prevent clogging, can result in irritation of the skin. Using tape to secure the catheter or other tubing to the body is unsuitable because, in addition to the potential for skin irritation and allergic reaction, as well as for infection from the breakdown of the skin, the taping does not afford the desired freedom of movement of the patient without fear of dislodging the catheter. Moreover, when the end of the catheter taped and pinned is visible from the outside of the clothing, it presents an unsightly and disturbing appearance which can produce mental distress in sensitive patients and children.

Similarly, feeding tubes which are implanted in the body of a patient for an extended period of time are used to administer enteral nutrition directly into the stomach or small intestine of the patient. These tubes typically exit the body on the left side in an area below the rib cage. Heretofore, any externally extending tubing portions of the implanted tubing were usually taped to the body, as were catheters. Also, similarly, heretofore surgical drains which were implanted in the body following surgery were usually taped to the body or taped and/or pinned to the patient's clothing.

Wires with electrodes for electrocardiograph units, or for heart monitors, were generally attached to the body merely at the point to be measured. A transmitter which stores the data, a box measuring approximately 3"×5", was held next to the patient's body by a cord tied around the patient's neck. When the transmitter is inadvertently moved during sleep or normal activity, it could move the wires and pull off the electrodes that attach the wires to the skin. Similarly, pumps used to dispense intravenous medications through central venous catheters were likely to pull on the exit side of the catheter.

Previous makeshift devices mentioned above, such as burn gauze, burn netting and elastic bandages, do not adequately secure the catheter and/or other types of tubing or cables, as they do not remain in place, and they lose their shape in a short period of time. While these devices may secure the catheter initially, they are not sufficient to maintain the catheter in place when the patient moves.

Conventional means of securing a catheter and/or other types of tubing or cables to the body do not protect the exit site of the tubing, nor does it prevent dislodgement and accidental removal of the catheter and/or tubing or cables. This is particularly a problem for young patients or for those patients who cannot control their movements, such as during sleep, or disoriented patients or patients who may purposefully move the body about in an excessive manner, such as patients with spastic muscles. These movements disturb the catheter exit site and may dislodge the catheter or other tubing, or displace the internally implanted tubing portion of the catheter, while also possibly aggravating and causing inflammation of the exit site. When the catheter or other tubing is taped to the body for retention, usually it is not possible to use the end of the external portion of the catheter without removing the tape retention means and reapplying the tape to the body or to the cap(s), which must be taped or pinned to clothing after each use of the catheter.

Once a catheter or other type of tubing is implanted, it need not be subjected to intervention over extended periods to time. Thus, it is important that the external portion and its end be stored out of sight and securely retained for permitting the desired freedom of the patient, while still providing ready access to the catheter or tubing should the need arise.

A number of attempts have been made to provide an alternative to taping a catheter to a patient's body, all with limited success. The most glaring omission of the previous attempts is that none of them has been successful in securing the catheter against both horizontal and vertical motion.

Daneshvar, in U.S. Pat. No. 5,336,195, discloses a wrapping unit for encircling a portion of the body which includes a support on the wrap for releasably holding an invasion apparatus, such as a catheter, on the wrap. Daneshvar uses a tray which has a plastic cover or strap which covers the trap, permitting the catheter to move horizontally. There is nothing in this unit to prevent the catheter from being moved either vertically or horizontally.

Pavelka, in U.S. Pat. No. 4,582,508, discloses a garment for holding, supporting and storing an indwelling catheter. A second body attachment element extends over the patient's shoulder. The pocket, however, does not secure the catheter to the body, and, therefore, the catheter can be moved out of position. The catheter is coiled and inserted into the pocket, rather than lying flat against the body. This coiling can possibly cause the catheter to pull on the incision in the body. The pocket must be detached to permit access to the catheter for, e.g., flushing, changing the dressing, administering medication such as chemotherapy, etc. Body protrusions such as breasts, may interfere with the ability of the pocket and straps to lie flat against the body. This garment does not appear to have a means to be put on and removed without disconnecting the infusion tubing, thereby increasing the risk of infection that is created by having to disconnect and reconnect the infusion tubing. Additionally, this garment does not provide a reliable way to secure feeding tubes or surgical drains, as they cannot be coiled to fit into a pocket without putting so much tension on the exit site that there is a danger of dislodging the tubing and, in the case of feeding tubes, causing granular tissue to build up around the exit site on the body.

McNeish et al., in U.S. Pat. No. 4,666,432, disclose a catheter retaining means and method for a surgically implanted catheter comprising a band of flexible material for being received about the body and over the exit site of the implanted catheter for protecting the body and retaining the tubing in position. The band has an opening and a pocket overlying the opening for receiving at least a part of the external tubing into the opening and for storing the free end therein. The catheter may be coiled to fit into the pocket, which may cause the catheter to pull on the incision in the body. This garment also appears to prevent a female wearer from wearing a separate brassiere at the same time as she wears the garment. As there is no easy means for ingress to the catheter exit site, the McNeish garment must be removed for dressing changes over the exit site. This garment does not appear to have a means to be put on and removed without disconnecting the infusion tubing, thereby increasing the risk of infection that is created by having to disconnect and reconnect the infusion tubing. Moreover, this garment does not provide a reliable way to secure feeding tubes or surgical drains, as they cannot be coiled to fit into a pocket without putting so much tension on the exit site that there is a danger of dislodging the tubing and, in the case of feeding tubes, causing granular tissue to build up around the exit site on the body.

Madden et al., in U.S. Pat. No. 5,244,464, disclose a band for securing and aligning medical tubing to the body. However, this device is merely a band which encircles the mid-section of a patient, and there is no vertical support for the band to secure a chest catheter or other tubing to prevent the catheter or other tubing from moving either vertically or horizontally.

Bird et al., in U.S. Pat. No. 5,352,209, disclose a band for securing a tube device to a limb or other body member comprising a primary stretchable strap which is secured about a body member and a secondary strap to retainably engage the tube. This device has no vertical support for a chest catheter to prevent the catheter from being moved either vertically or horizontally.

SUMMARY OF THE INVENTION

It is an object of the present invention to overcome the aforesaid deficiencies in the prior art.

It is another object of the present invention to provide a means for supporting and protecting at least one catheter or other type of indwelling tubing placed in the chest or other location on the body.

It is a further object of the present invention to provide a device for securing at least one catheter or other type of indwelling tubing close to the body while preventing horizontal or vertical movement of the catheter or other indwelling tubing.

It is another object of the present invention to provide a means to secure tubing such as catheters, feeding tubes, surgical drains and other indwelling tubing that exits the body, e.g., in the thoracic and abdominal areas, that can be customized for each person regardless of the location of the exit sites on the body and the types of tubing. This versatility ensures that the security garment is able to secure safely indwelling tubing for all patients despite the fact that the exit sites and types of tubing used may vary according to the patient, the surgeon, and/or the hospital.

It is another object of the present invention to provide a security garment which secures tubing without causing skin irritation and skin breakdown that is caused by using tape on the skin to retain tubing in place.

It is another object of the present invention to provide a security garment for use during infusions to prevent central venous catheters and infusion tubing from becoming tangled or kinked, as well as to help prevent feeding tubes from becoming tangled of kinked.

It is a further object of the present invention to provide means to retain tubing, wires, or cables attached to the surface of the body in place so that the tubing, wires, or cables are not dislodged.

It is another object of the present invention to provide a garment which supports at least one indwelling catheter or other tubing for infants, children and disoriented adults which makes it difficult for the wearer to touch both the exit site of the catheter and the catheter itself, while still providing access for caregivers to maintain the catheter and administer medications, parenteral nutrition, blood products, an the like.

It is another object of the present invention to provide a garment which can be worn by colostomy and/or ileostomy patient who also have at least one catheter or indwelling tubing on the trunk of the body, which garment does not interfere with the colostomy and/or ileostomy appliance.

Similarly, it is another object of the present invention to prevent tubing from contacting soiled diapers.

It is another object of the present invention to be able to put on and remove the garment without disconnecting the catheter and feeding tube from the infusion tubing.

It is another object of the present invention to provide a support for at least one catheter or indwelling tubing which permits access to the catheter or indwelling tubing for maintenance and administration of, for example, medications, parental nutrition and blood products, as well as for withdrawal of blood for testing.

It is another object of the present invention to provide a reusable support for indwelling tubing which can easily be cleaned by machine washing and drying.

It is still another object of the present invention to provide a support for at least one indwelling catheter or other tubing which permits easy changing of a dressing surrounding the catheter or other tubing.

It is a further object of the present invention to provide a security garment to hold telemetry transmitter units for recording electrocardiographs, as well as cables which lead from the transmitter and are attached to the upper body with electrodes. Similarly, the security garment holds pumps attached to catheters used to dispense intravenous medications.

For purposes of the present invention, "catheter" includes any type of tubing or wires exiting from a patient's body and is not strictly limited to catheters per se. Likewise, the use of the term "tubing" or the like for purposes of the present invention includes any type of tubing or wires which exit from a patient's body. These terms are interchangeable and are not limited to any specific type of tubing or material that exits a patient's body for ingress or egress of fluids or other materials.

According to the present invention, a security garment is provided to support at least one catheter or other type of implanted or indwelling tube in a patient. The security garment may be in the form of a nether garment such as an undershirt, with adjustable, detachable shoulder straps and an adjustable side closure or back closure. The security garment with a back closure makes it more difficult for young children and other patients who are unable to control their movements, e.g., Alzheimer's patients or patients with palsy, to touch the tubing or its exit site. The security garment may be sleeveless or may have long or short sleeves.

The security garment of the present invention has an outer layer that can be made of any type of fabric, including woven or non-woven cotton, Lycra®, polyester, nylon, polypropylene, silk, or any other natural or synthetic fiber suitable for making garments. The outer layer has fastening material on the inside, that is, the side facing the body. Underneath the outer layer is a first inner layer made of fastening material. This fastening material includes fastening means to attach the inner layer to the inside of the outer layer and fastening means to secure tubing to the top of the inner layer. Such fastening means can include, but are not limited to, any conventional fastening means, such as Velcro®, hook and loop fasteners, eyes (for hook and eye fasteners), female snaps to mate with male snaps, pressure sensitive adhesive, pins, stitches, or the like. This inner layer extends across the entire front of the garment and body. The inner layer may be approximately from two to twelve inches wide, depending on the size of the security garment. The inner layer can be moved to reveal the exit site of the tubing where the tubing exits the body of the patient. Once the inner layer is positioned below the exit site, the tubing can be placed on top of this inner layer and secured to the inner layer by the mating fastener means, e.g., Velcro®, hook and loop, hooks and eyes, male snaps to mate with female snaps, pressure sensitive adhesive, etc. The outer layer is then closed over the inner layer, with the fastening means on both the outer and inner layer providing the support to hold up the inner layer and retain the tubing in place on the patient's body.

The inner layer provides substantially unlimited choices in the location in which the indwelling tube is secured. Additionally, the inner layer can be used to create a tension loop in a catheter or feeding tube. A tension loop is made as a safety precaution: in the event that the end of the catheter or feeding tube is pulled, the tension loop is pulled on before the exit site of the catheter is pulled. Similarly, for catheters and feeding tubes with more than one lumen, the inner layer can be used to secure lumens at the point where they branch out from the single main tube. If the catheter is pulled at the ends, the point at which the lumens branch out from the single tube will be pulled on before the exit site is pulled. For catheters and surgical drains exiting in the thoracic area, such as central venous catheters, cardiac catheters, and surgical drains placed following mastectomy, the inner layer can be placed across the thoracic area. For feeding tubes and surgical drains exiting in the abdominal area, the inner layer can be located across the midriff area. More than one inner layer can be used to secure more than one tube with exit sites in different areas, e.g., a central venous catheter exiting in the thoracic area and a feeding tube exiting in the abdominal area.

In another embodiment of the present invention, the security garment is designed to hold exteriorly located devices such as telemetry electrocardiograph units and pumps used to dispense chemotherapy. The garment is in the form of an undershirt or a vest with an outer layer and an inner layer. The inner layer comprises a support for the unit such as a pocket in the inner layer. Wires or tubing exiting from the unit are attached to the patient's skin in any conventional manner. Both the inside of the outer layer and the outside of the inner layer are provided with a fastening material so that the inner layer is fastened to and thereby supported or held up by the outer layer. The outer layer is then closed over the inner layer, retaining the unit and the wires or tubing in place on the patient's body. The inner layer can be made to hold any desired tube wire, cable, etc., such as a catheter, feeding tube, surgical drain, transmitter pump, or cable. The inner layer can be detached and moved vertically in the thoracic and abdominal areas so that it is positioned in the appropriate place to secure the tube, wire, cable, etc.

In another embodiment of the present invention, the security garment can accommodate exit sites for central venous catheters, cardiac catheters, and other types of tubing that are placed in the thoracic and abdominal areas. The security garment has the appearance of an undershirt or a vest. It has one or more openings that begin at the armhole, the neckline, the shoulder strap, and/or the hem of the garment, and the catheter can be threaded through this opening and secured using fasteners that line the opening. The fastening means are located so that any irritating portion of the fastening means is positioned facing away from the patient's skin so as to prevent skin irritation; other fastening means, where appropriate, are positioned on the front of the garment.

Another version of the security garment of the present invention includes detachable shoulder straps divided into two strips, with the opening ending approximately in the area above and inside of the nipples of the wearer. The opening runs diagonally from the shoulder to the center of the chest. All versions of this garment in undershirt form have adjustable, detachable shoulder straps and an adjustable side or back closure. In addition, all versions of the security garment can be provided with protective covers that fasten onto the side or the back of the security garment. This protective cover makes it more difficult for young children or very active patients to touch the tubing and its exit site, or to have the tubing accidentally caught on something.

Feeding tubes can be threaded through openings that begin at the bottom hem on the front of the security garment and can be secured using fastening means described herein. One example of such fastening means is Velcro, hooks and loops, wherein the hook and loop fasteners line the opening, with the hook portion facing away from the skin to prevent skin irritation, and with other hook and loop fasteners positioned on the front of the security garment or with a pocket to hold the tube after it is threaded through the opening. The security garment can be provided with additional features to support feeding tubes while, at the same time, supporting central venous catheters. For example, patients may remain on total parenteral nutrition introduced through a central venous catheter while beginning receipt of enteral nutrition through a feeding tube. Alternatively, the security garment can be made with features to secure only feeding tubes and without features to secure catheters. The arrangement of securing means is limited only by the location on the patient's body where the tubes exit the body.

The security garment of the present invention is compatible with continuous around-the-clock infusion because the garment can be put on and removed without disconnecting the catheter from the infusion tubing, which reduces the potential for infection. This is made possible by the design of the garment with its detachable shoulder straps, its side or back openings, and its openings that hold the catheter or feeding tube that are accessible either from the shoulder straps, the armholes, necklines, hems, or the side and back openings.

The security garment of the present invention covers most catheter and feeding tube exit sites in the thoracic and abdominal areas. The security garment helps prevent the person with the catheter or other tubing from touching the exit site and/or dressing covering the site, thereby helping to decrease the potential for infection.

The security garment of the present invention eliminates the need for a bulky dressing over the catheter exit site. The secure fit of the garment is made possible by its design, which includes adjustable shoulder straps and side or back closures using fastening means such as, but not limited to, hook and loop fasteners and the use of stretchable fibers such as Lycra®, in the fabric from which the garment is made. Thus the security garment is able to retain gauze or dressings in place without the need for additional tape to secure the gauze or dressing in place on the patient's body.

The security garment of the present invention is provided with adjustable shoulder straps using fastening means such as hook and loop fasteners, hooks and eyes, zippers, buttons, or snaps, or any fastening means which retains the shoulder straps in place, resulting in a secure fit.

In another embodiment of the present invention, the security garment is in the form of a "sports bra", which supports at least one central venous catheter or other type of tubing as well as the breasts. One version of this security garment has detachable shoulder straps divided into two strips, with the opening usually ending in the area above and to the inside of the nipples of the wearer. The opening runs diagonally from the shoulder towards the center of the chest. Another version of this garment has one or more openings that begin at the armhole or neckline of the garment that are lined with hook and loop fasteners. The garment has adjustable shoulder straps and a side closure using fasteners such as hook and loop fasteners. The garment can have additional hook and loop fasteners on the front of the bra and/or larger pieces of loop fasteners sewn onto the front of the garment to provide greater choices in where the catheter can be secured using unattached strips of hook fasteners. This embodiment makes it possible for a female patient to wear only the security garment, rather than a separate bra and security vest.

Any of the security garments with an undershirt configuration, as described above, can be extended in length so that they can be fastened between the legs, similar to the garment used for young children commonly called a "onesie" or bodysuit. A detachable strap can be attached to the bottom of the front and back of the garment so that it is placed between the legs. This strap can be adjusted for length using hook and loop fasteners. This embodiment provides an additional way to prevent the garment from "riding up" on the wearer. Also, any of the garments with an undershirt configuration can be made sleeveless, or with long or short sleeves.

As another embodiment of the present invention, the security garment can accommodate and retain in place peripherally inserted central catheters. Peripherally inserted central catheter lines are designed for administration of intravenous fluids, blood products, medications and parenteral nutrition, as well as for withdrawal of blood. The catheter is placed into one of the large antecubital veins in the arm and is threaded into the superior vena cava above the right atrium. The exit site for the peripherally inserted central catheter line is usually in the area just above or below the inside of the elbow. Peripherally inserted central catheter lines can have single or double lumens.

Additionally, an attachment to the security garment is provided to be used in training a patient or caregiver in catheter care.

DETAILED DESCRIPTION OF THE INVENTION

For purposes of the present invention, "fastening means" or "fastener" includes any device which fastens one portion of the security garment to another portion of the security garment, or to another fabric to support that portion of the security garment, or to hold the security garment in place on a patient, or which retains at least two straps in place on a catheter or other tubing to retain the catheter in place. Such fastening means can include, but is not limited to, hook and loop fasteners; hook and eye fasteners; adhesives, including reusable adhesives; adhesive tape; zippers; buttons; snaps; pins; stitching; clamps; and the like. These fastening means are provided merely by way of illustration and are not intended to be limited to the specific example enumerated.

For purposes of the present invention, the phrases "tubing which exits a patient's body" or "catheters" refer to catheters, feeding tubes, surgical drains, and any other type of tubing or wiring which is implanted in a patient's body and which exits the patient's body through an opening in the skin. The term "tubing which exits a patient's body" is not limited to any number or types of tubes or wires, or whether the tubes are used for introducing substances into or draining substances from a patient body. Unless specified, these terms are interchangeable and include all variations of the terms.

FIGS. 1A–1L show security garments according to the present invention that comprise an outer shell and an inside layer or band which can be designed to accommodate a variety of catheters, feeding tubes, surgical drains, wires, cables, and the like.

Figure 1A:
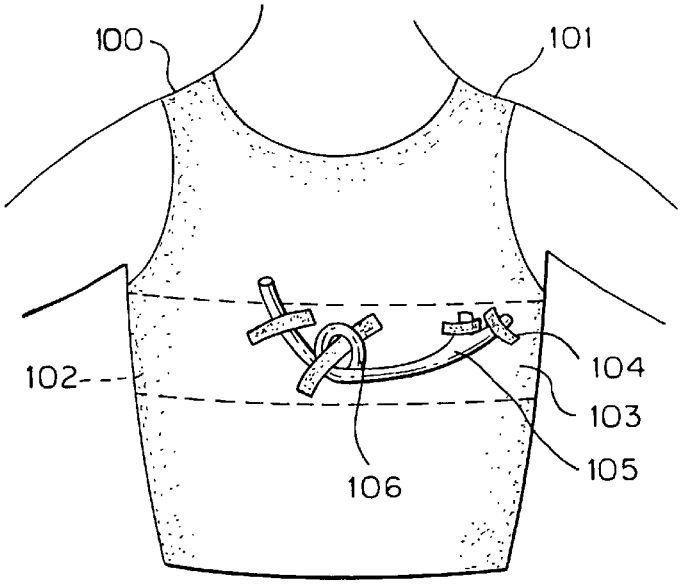
FIG. 1A shows a security garment configured like an undershirt.

FIG. 1A shows one embodiment of a security garment which comprises an outer shell and an inside layer/band which can be designed to accommodate a variety of catheters, surgical drains, wires, cables, and the like. The outer shell 101, which is shown in the form of an undershirt, but which can be made with short or long sleeves or with other types of necklines, can be made of any type of fabric that is comfortable for the wearer, such as cotton Lycra®, polyester blends, or any other fiber that is suitable for making clothing. Shown underneath the closed outer shell is an inside layer/band 102 which is attached to the outer shell using hook and loop fasteners in any desired configuration. These fastening means are used to secure and hold up the inner layer/band 102 by fastening hook fasteners on the inner layer (not shown) that mate with loop fasteners on the outer shell (not shown). These loop fasteners are optionally cut into strips that can be positioned to extend vertically on one side of the body from the armhole to the hem of the garment, and in the center of the body from the front of the neckline to the hem of the garment. Strips of loop fasteners positioned vertically can allow the inside layer/band to be positioned either directly below the tubing exit site or wherever appropriate.

The inner layer/band 102 comprises a band that extends across the front of the body and can be made in varying widths. The band 102 is made of two layers, with an inner layer, which is next to the skin, made of any suitable fabric, woven or non-woven, that can be used for making garments. The outer layer of the band is made of loop fasteners or any other type of fastening means. The band 102 extends across the front of the body from the left side of the body to the right side of the body. However, the inner layer of the band band can also be configured to extend across the front of the body from the right side to the left side of the body. While the inner layer/band 102 can be of any width, depending upon the size of the garment and the type of tubing which the band 102 is intended to hold, inner layer/band is generally from about two to about twelve inches wide. The band 102 is secured to the outer layer 101 of the garment using hook-type fasteners (not shown) which are attached to the front of the band 102 to enable the band 102 to be secured to loop fasteners attached to the inside of the outer layer 101. Of course, any type of fastening means can be used for this purpose.

Soft binding is provided around the edges of the inner band 102 to protect the patient's skin. The entire front side of the band 102 is comprised of loop fasteners 103 or other fastening means that can be used to secure tubing when thin strips of hook fasteners 104, or any type of mating fasteners, are placed over the tubing 105. Depending upon the location of the exit site of the tubing, the tubing 105 can then be brought on top of the inner layer/band 102, which can be made of loop fasteners, and secured to the front of the loop band using strips of hook fasteners 104 that can be attached to the inner band where needed. This provides great versatility in the ways that the tubing can be secured. For instance, the hook fasteners 104 can be used to create a tension loop in a catheter. The tension loop is provided as a safety precaution; in the event that the end of the catheter or tube is pulled, the tension loop is pulled before the exit site is pulled. Similarly, for catheters and feeding tubes with more than one lumen, the hook part 104 of the fastening means can be used to secure lumens at the point where they branch out from the single main tube. If the catheter is pulled at the ends, the point at which the lumens branch out from the single tube will be pulled on before the exit site is pulled. For catheters and/or surgical drains exiting in the thoracic area, such as central venous catheters, cardiac catheters, and surgical drains placed following mastectomy, the inner layer/band 102 containing the fastening means can be placed across the thoracic area, as shown in FIG. 1D.

Figure 1B:
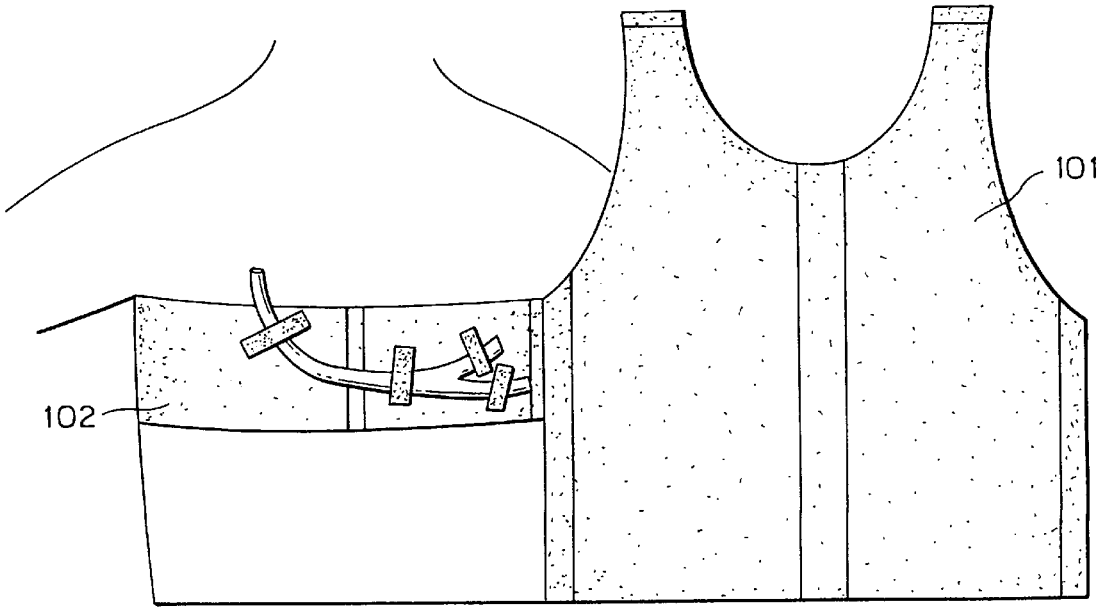
FIG. 1B shows the security garment of FIG. 1A with the outer layer open to reveal the inner band underneath which secures a central venous catheter.
Figure 1C:
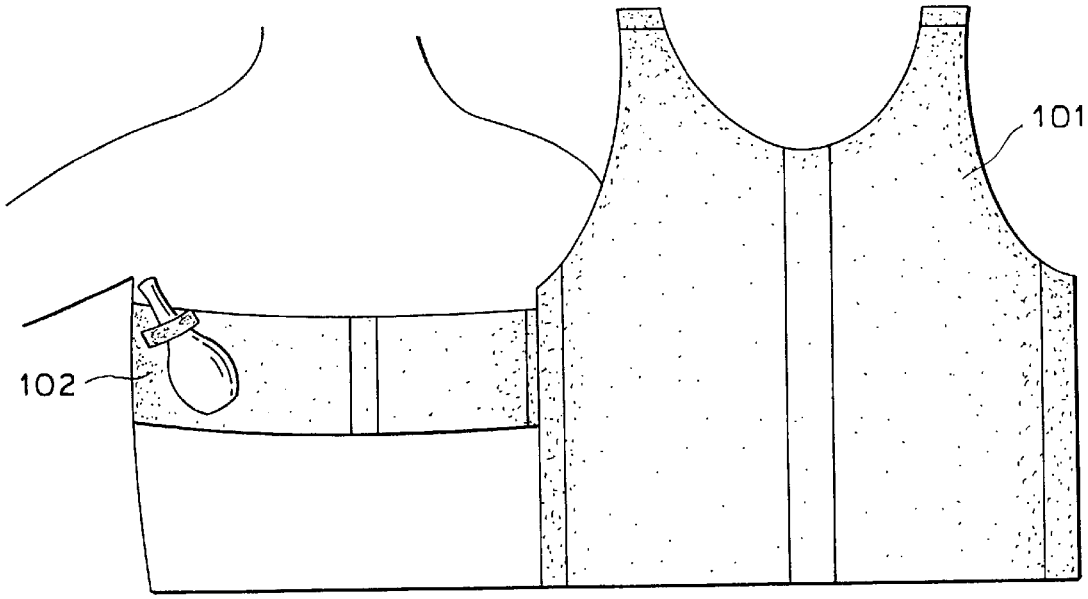
FIG. 1C shows the security garment of FIG. 1A with its outer layer open to reveal the inner band which retains a surgical drain.
Figure 1D:
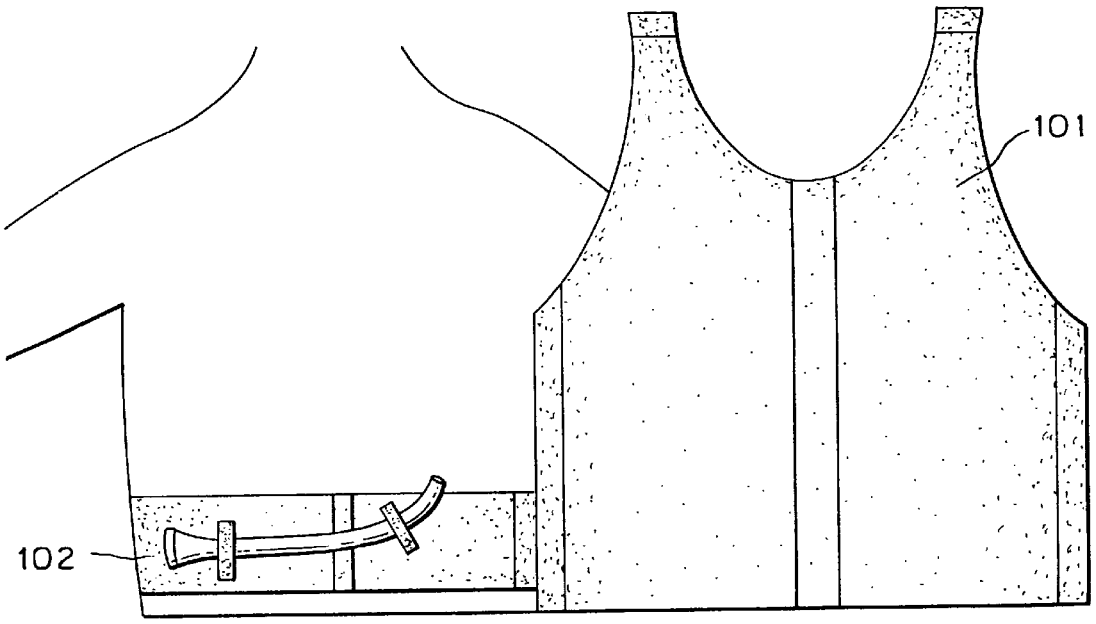
FIG. 1D shows the security garment of FIG. 1A with its outer layer open to reveal the inner band which retains a feeding tube.
Figure 1E:
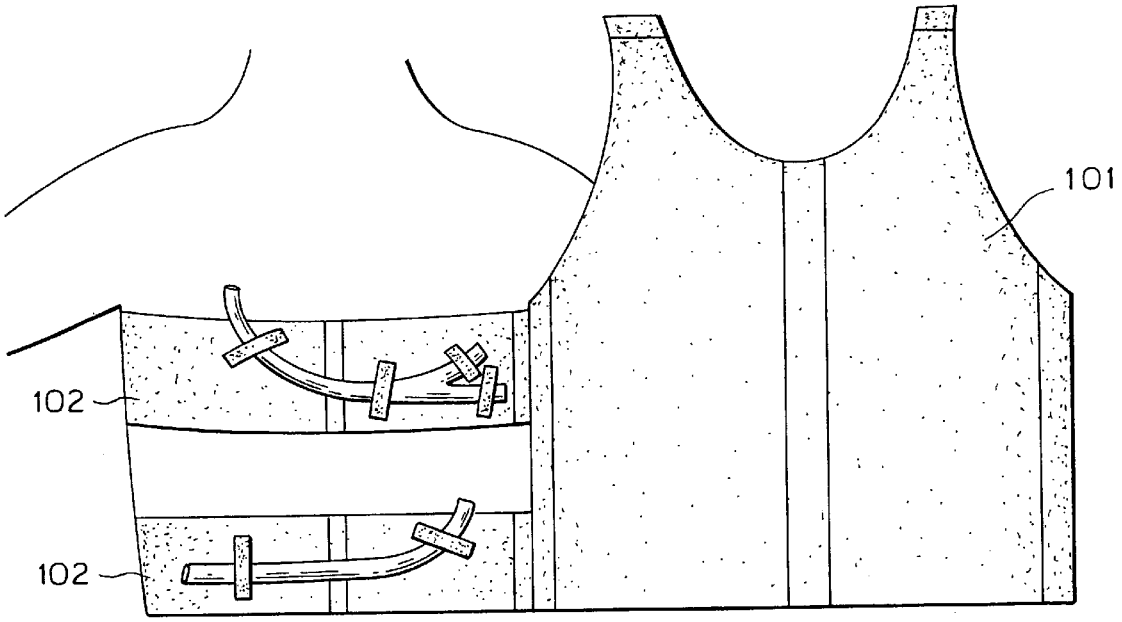
FIG. 1E shows a security garment with means to retain both thoracic and abdominal catheters in place.
Figure 1F:
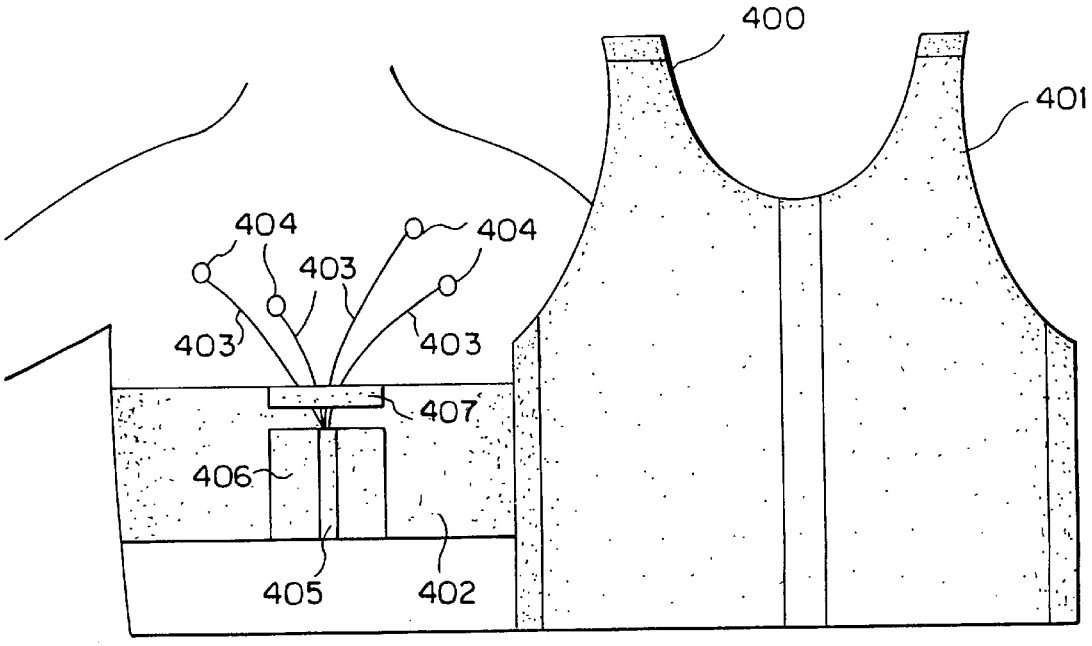
FIG. 1F shows a front view of a security garment with the outer layer open to reveal inside the band which supports an electrocardiograph unit.

Optionally, the inner layer/band 402 can be made with a pocket, 406 as shown in FIG. 1F to hold a telemetry unit or a pump used to dispense intravenous medication through central venous catheters. The pocket is located on the front of the inner band and has an open top with closed bottom and sides.

FIG. 1B shows the security garment in FIG. 1A with the outer layer 101 open to reveal the inner layer/band 102 underneath said band 102 is shown securing a central venous catheter.

FIG. 1C shows the security garment in FIG. 1A with the outer layer 101 open to reveal the inner layer/band 102 underneath. The inner layer/band 102 secures a surgical drain.

FIG. 1D shows the security garment of FIG. 1A with the outer layer 101 open to reveal the inner layer/band 102 underneath. The band 102 secures a feeding tube that exits the body in the abdominal area.

FIG. 1E show the security garment in FIG. 1A with the outer layer 101 open to reveal two bands 102 underneath the outer layer. The two inner bands 102 are shown securing a central venous catheter that exits the body in the thoracic area and a feeding tube that exits the body in the abdominal area.

FIG. 1F shows a front view of the security garment 400 with the outer layer 401 open to reveal a band 402 which supports an electrocardiograph unit from which exit the wires 403 from the unit to electrodes 404 to be placed in varied locations on the outside of the patient's body. The band 402 is provided with fastening means 405 to retain the inside layer/band 402 on the outer layer when the outer layer is closed over the inner layer/band 402. The preferable fastening means is a combination of hooks and loops, although any type of fastening means can be used, including snaps, hooks and eyes, pins, resealable adhesive, stitching, and the like. A pocket 406 is provided to hold the telemetry unit. The size of the pocket can be such to fit the type of unit to be supported. Straps 407 are attached to the inner layer/band 402 to hold the unit and wires or cables in place by any type of conventional fastening means. While hooks and loops are the preferred fastening means, any type of conventional fastening mean may be used for this purpose. Similarly, the pocket 406 on the band 402 can hold small, lightweight pumps used to dispense intravenous medications such as chemotherapy through implanted central venous catheters.

Figure 1G:
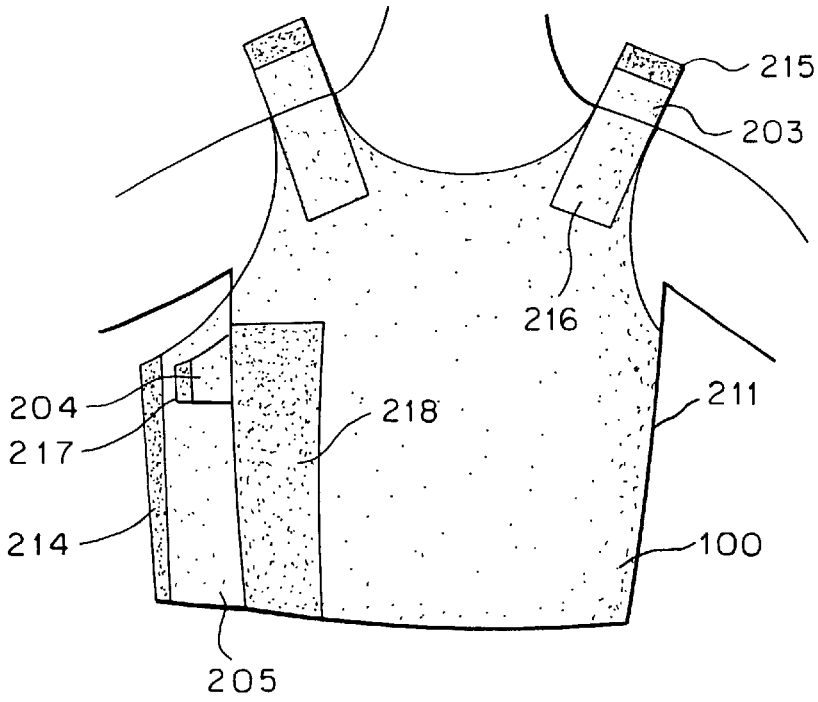
FIG. 1G shows the outer layer of a security garment which has detachable, adjustable shoulder straps, an adjustable side closure, and an inside band with an adjustable side closure.

FIG. 1G is a back view of the security garment 100 of FIGS. 1A–1F shown with a side closure. This security garment has straps 203 which attach from the front of the security garment to the back 211 of the security garment over the shoulders of the patient. Fastening means 216 are shown to anchor the straps to the back of the garment by complementary fastening means 215 on the straps. The inner layer/band is shown at 204. Fastening means for the band 204 are shown at 217, anchor the band to the side of the garment by complementary fastening means 218 on the side of the garment. Fastening means for the outer layer 205 of the garment are shown at 214 to anchor the outer layer to the side of the garment by complementary fastening means 218 on the side of the garment. Having a separate back closure for the band 204 and for the outer layer 205 of the garment makes it possible to lift the outer layer 205 to examine the tubing, the exit site, and/or the dressing covering the exit site while keeping the inner layer/band 204 securely fastened.

Figure 1H:
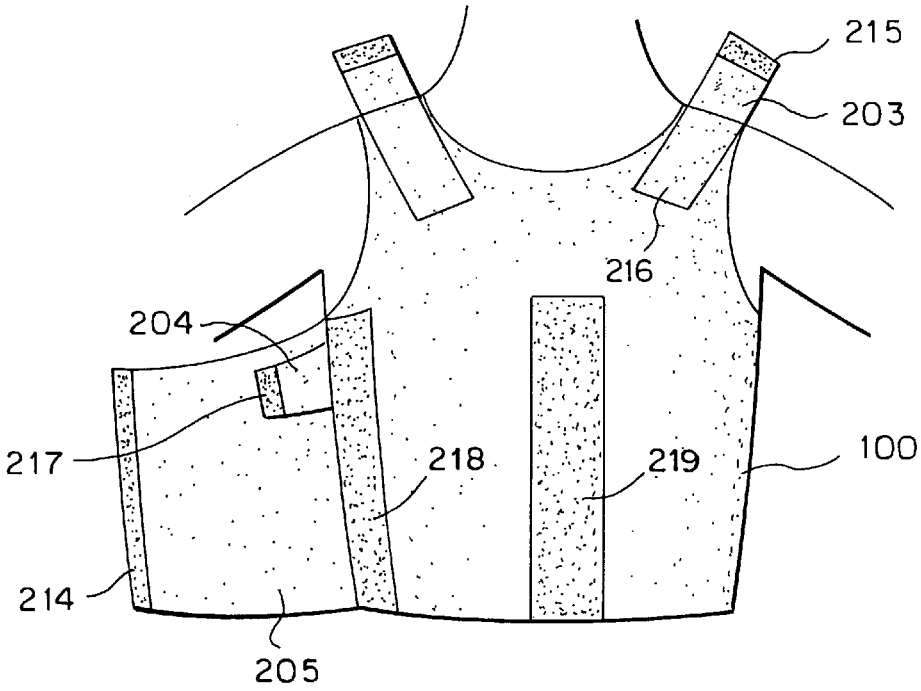
FIG. 1H shows the outer layer of a security garment which has detachable, adjustable shoulder straps and which has an adjustable back closure and an inside band with an adjustable side closure.

FIG. 1H is a back view of the security garment 100 in FIGS. 1A–1F shown with a back closure. While similar to the garment shown in FIG. 1G, fastening means 214 for the outer layer 205 of the garment anchor the outer layer 205 to the back of the garment by complementary fastening means 219 on the back of the garment.

Figure 1I:
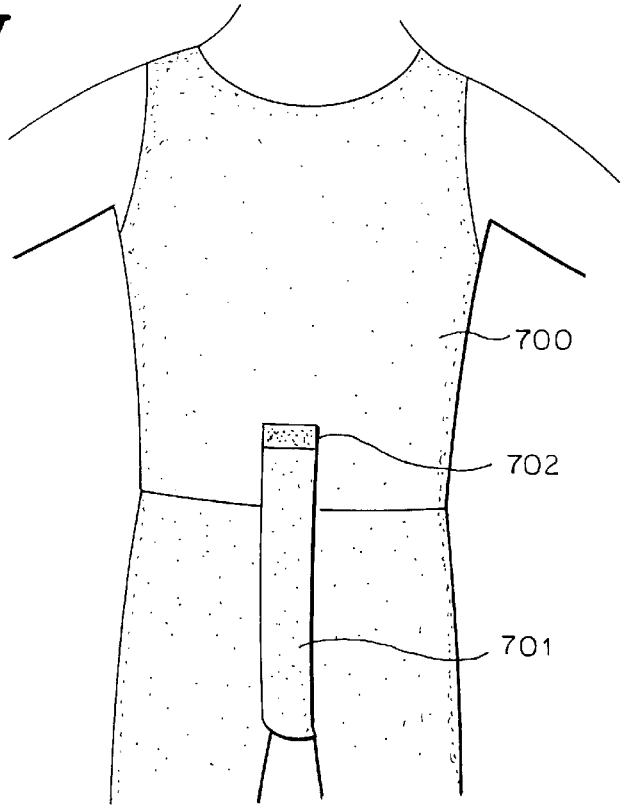
FIG. 1I shows the front of a security garment with a detachable strap attached to the bottom of the garment on the front and on the back.
Figure 1J:
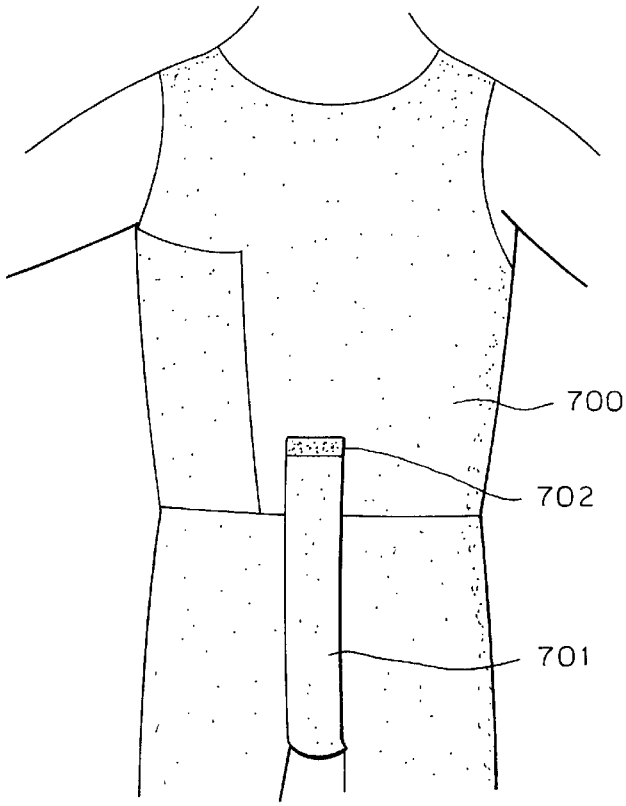
FIG. 1J shows the back view of the security garment of FIG. 1I with the strap attached.

FIG. 1I shows a front view of a security garment 700 with a detachable strap 701 attached to the bottom of the garment on the front and on the back to prevent the garment from moving up on the body during activity such as sleep. By preventing the garment from riding up on the body, it is thus possible to prevent moving the tubing. The strap 701 can be made of any suitable fabric, either the same fabric as the security garment, or another flexible fabric such as cotton or cotton blends, and can be attached to the bottom of the garment by any suitable fasteners 702. The use of hook and loop fasteners permits adjusting the length of the strap to accommodate torsos of different lengths. FIG. 1J shows the back view of the security garment 700 with the strap attached.

Figure 1K:
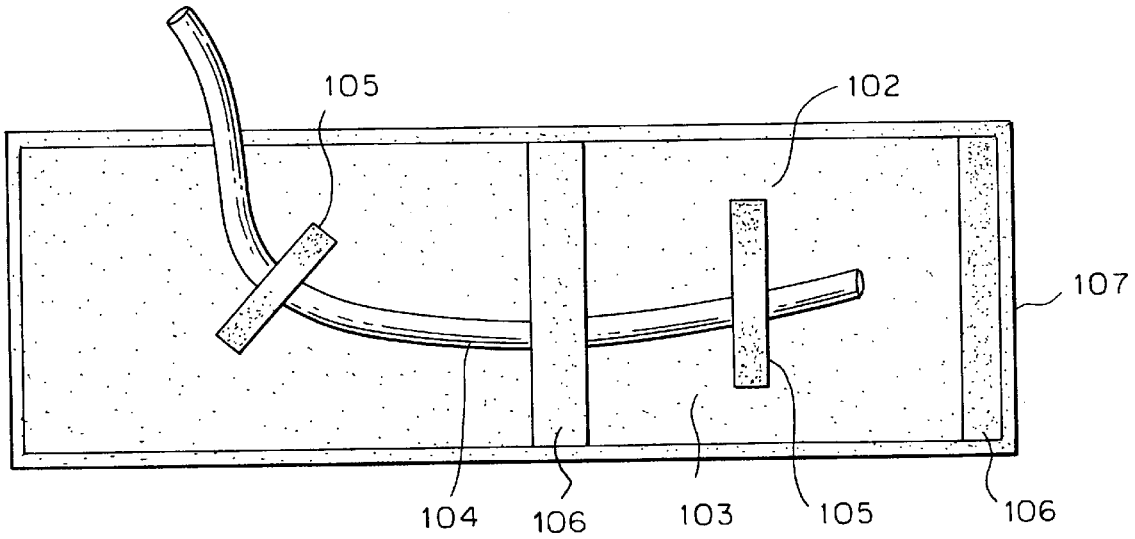
FIG. 1K shows the front of the inner band used to secure catheters.

FIG. 1K shows the front of the inner layer/band 102 used with the security garment shown in FIGS. 1A–1F. Soft binding 107 is provided around the edges of the band 102 to protect the patient's skin. The entire front side of the band 102 is comprised of loop fasteners 103 or other fastening means that can be used to securing tubing 104 when thin strips of hook fasteners 105, or any other type of mating fasteners, are placed over the tubing. Additional hook fasteners 106 are attached to the front of the inner layer/band 102 to secure the band to complementary fastening means on the inside of the outer layer.

Figure 1L:
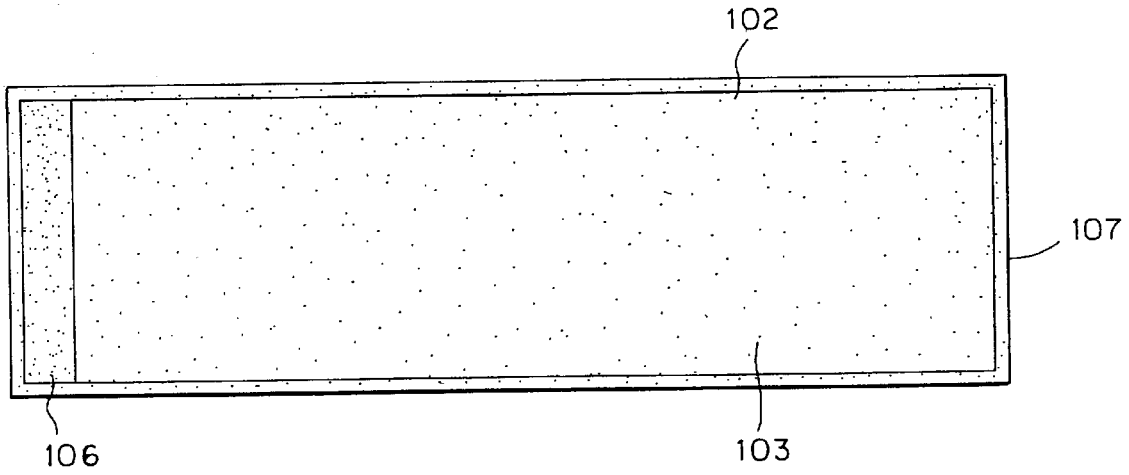
FIG. 1L shows the inside layer of the inner band used to secure catheters.

FIG. 1L shows the back of the inner layer/band 102 shown in FIG. 1K. Soft binding 101 is provided around the edges of the inner layer/band 102 to protect the patient's skin. The entire back side of the band 102 is comprised of any type of fabric that is comfortable to the wearer, such as cotton/Lycra®. Hook fasteners 104, or any other type of fastening means, are attached to the back of the band 102 to anchor the band 102 to complementary fastening means on the side of the garment.

FIGS. 2A–2L show embodiments of a security garment that can be customized to secure tubing that exits the body in the thoracic and abdominal areas.

Depending upon the location of the tubing exit site, openings can be placed on the front of the garment so that the tubing can be threaded through the opening and secured on the front of the garment with hook and loop fasteners and/or with pockets. These openings can begin at the shoulder straps, armholes, neckline, and/or hem. All of the garments have detachable, adjustable shoulder straps and can be made with side or back closures. In addition, all of the garments can have a protective cover attached thereto.

When the tubing is threaded through an opening, in the garment the tubing can be secured to the front of the security garment in a number of ways, including straps made of hook and loop fasteners, pockets or by placing thin straps of hook over tubing to secure the hooks to larger patches of loops sewn onto the front of the garment. Using larger patches of loops provides greater flexibility to secure tubes of varying lengths and lumens.

Figure 2A:
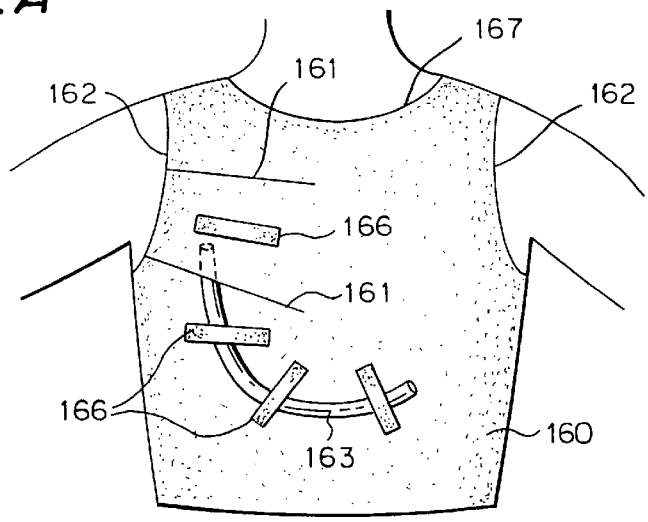
FIG. 2A shows a front view of a security garment in an undershirt configuration that can be customized to secure tubing that exits the body in the thoracic and abdominal areas.

FIG. 2A shows a security garment 160 which can retain central venous catheters and other types of tubing which exit in the thoracic area. The garment 160 has one or more openings 161 that begin at the armhole 162 or at the front neckline 167. A catheter 163 is threaded through the opening (s) 161 and secured using, for example, hook and loop fasteners (not shown) that line the opening 161 in the garment. The hook portion of the fasteners is preferably positioned facing away from the skin to prevent skin irritation, and other hook and loop fasteners 166 can be positioned on the front of the garment to secure the tubing 163. More than one catheter or tube can be retained by providing multiple openings in the garment.

Figure 2B:
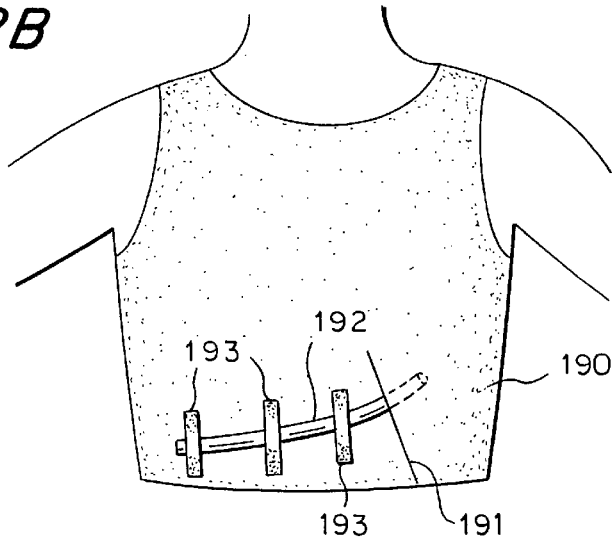
FIG. 2B shows a front view of a security garment which accommodates catheters and other types of tubing that have exit sites in the abdominal area.

FIG. 2B shows a security garment 190 with a slit or opening 191 from the hem for a feeding tube 192. The feeding tube 192 is threaded through the opening 191 and secured using, for example, hook and loop fasteners (not shown) that line the opening 191 of the garment. The hook portion of the fasteners is preferably positioned facing away from the skin to prevent skin irritation, and other hook and loop fasteners 193 can be positioned on the front of the garment to secure the tubing 192.

Figure 2C:
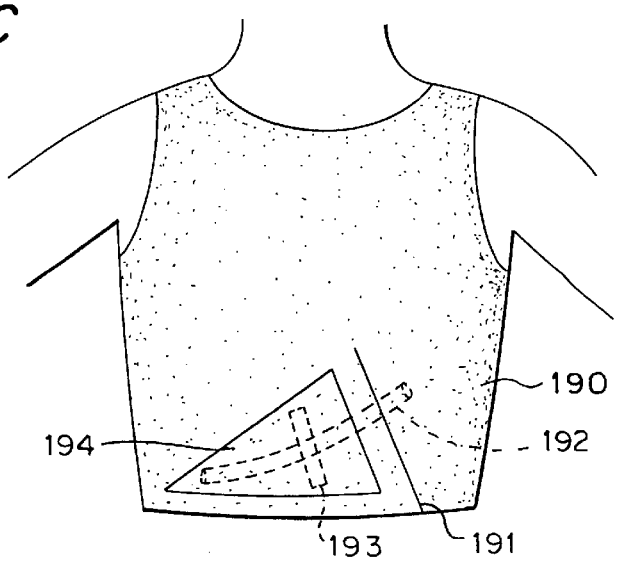
FIG. 2C shows a security garment according to FIG. 2B with a pocket for the catheter.

FIG. 2C shows the security garment of FIG. 2B with a pocket 194 to retain the outer end of the feeding tube 192.

Figure 2D:
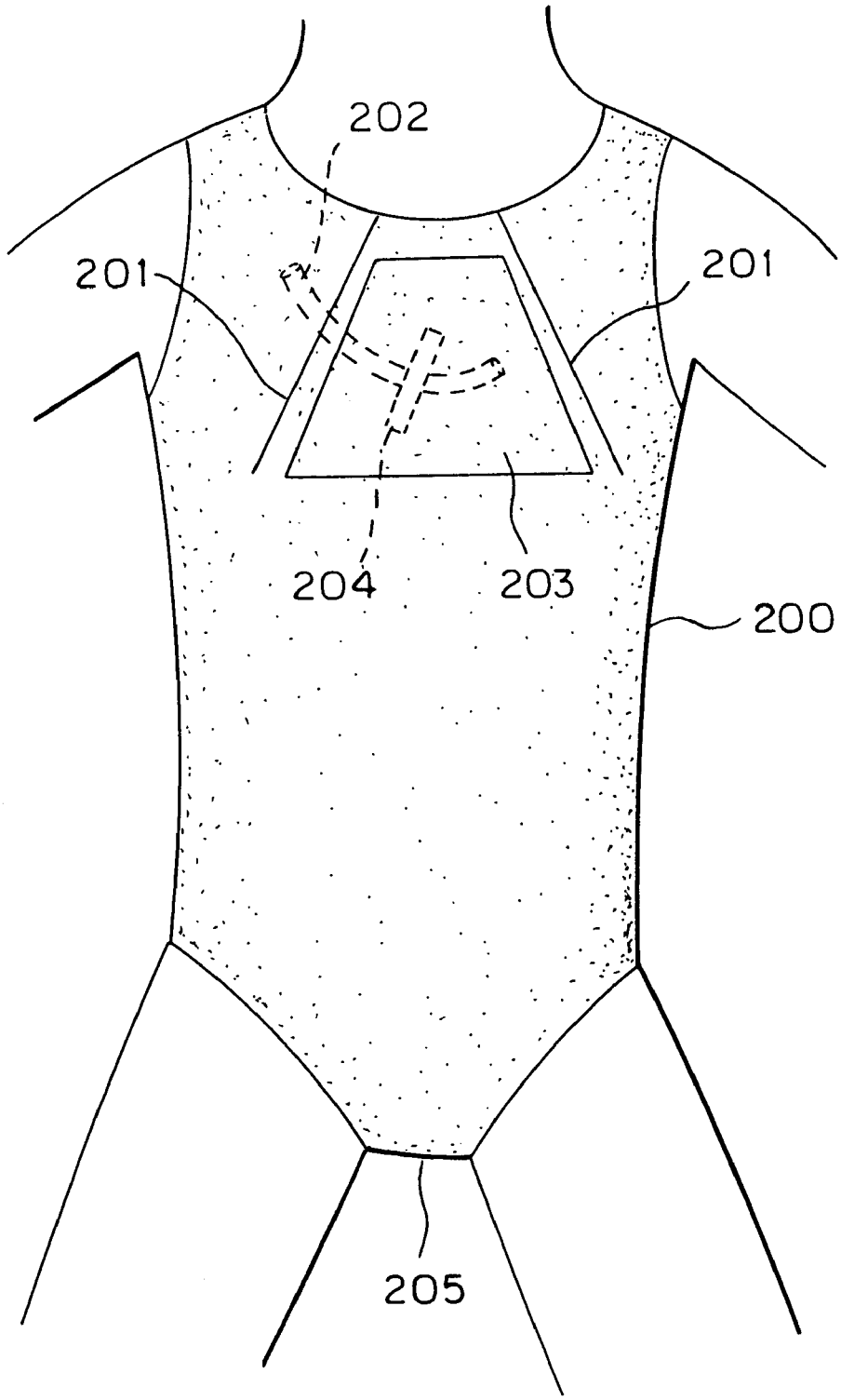
FIG. 2D shows a security garment configured like a "onesie" with openings from the neckline to accommodate catheters that exit in the thoracic area.

FIG. 2D shows a security garment 200 with openings or slits 201 from the neckline from which a central venous catheter 202 or other type of tubing can exit the security garment. A pocket 203 can be provided to retain the tubing in place, as well as hook and loop fasteners 204 attached to the front of the garment to secure tubing. The security garment of FIG. 2D is shown in the form of a "onesie" that is secured between the legs 205 and keeps the garment 200 and tubing 202 from moving up on the body.

Figure 2E:
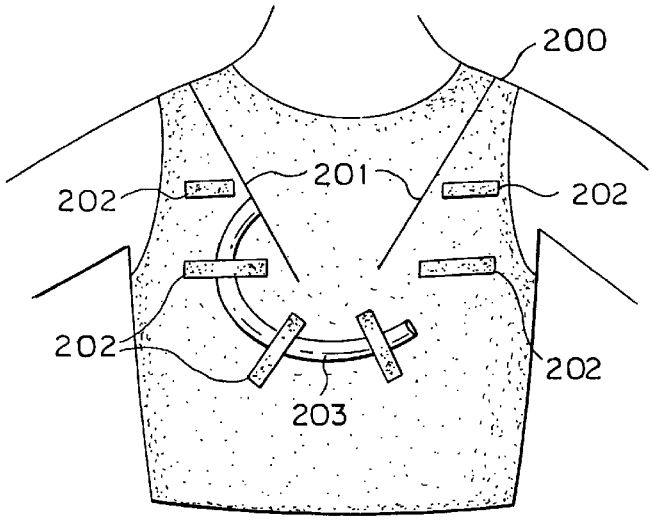
FIG. 2E shows a security garment with openings in the shoulder straps.

FIG. 2E shows a security garment 200 with a slit or opening 201 originating in one or both shoulder straps and ending in the middle of the chest. Each opening 201 can be lined with hook and loop fasteners to secure tubing 203 threaded through the opening. Additional hook and loop fasteners 202 can be placed on the front of the garment to secure tubing 203.

Figure 2F:
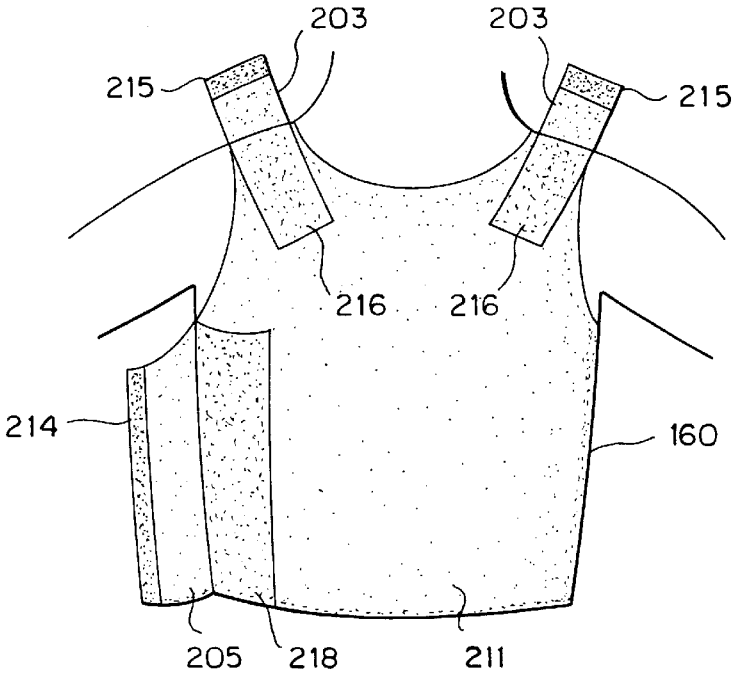
FIG. 2F shows a back view of the security garment of FIG. 2A with detachable, adjustable shoulder straps and adjustable side closure.

FIG. 2F shows the back view of security garment 160 in FIGS. 2A–2E shown with a side closure. This security garment has straps 203 which attach from the front of the security garment to the back 211 of the security garment over the shoulders of the patient. Fastening means 216 on the garment 160 are shown to anchor the straps to the back of the garment 160 by complementary fastening means 215 on the straps. Additional fastening means 214 anchor the front 205 of the garment 160 to the side via complementary fastening means 218 on the side of the garment.

Figure 2G:
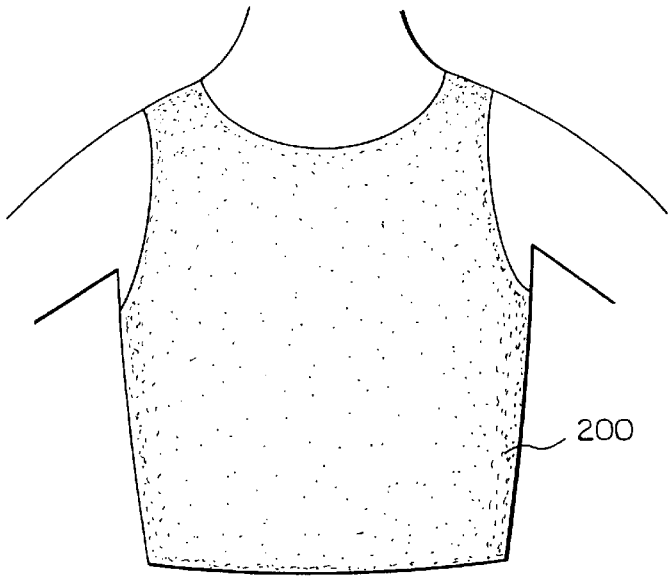
FIG. 2G shows a front view of the security garment of FIG. 2A with a protective cover in the closed position.

FIG. 2G shows the security garment shown in FIGS. 2A–2E with a protective covering 200 attached to the security garment with the covering shown closed. A protective covering can be attached to the security garment for those people who cannot control their movements, such as young children, patients with palsy, or patients with dementia such as Alzheimer's disease.

Figure 2H:
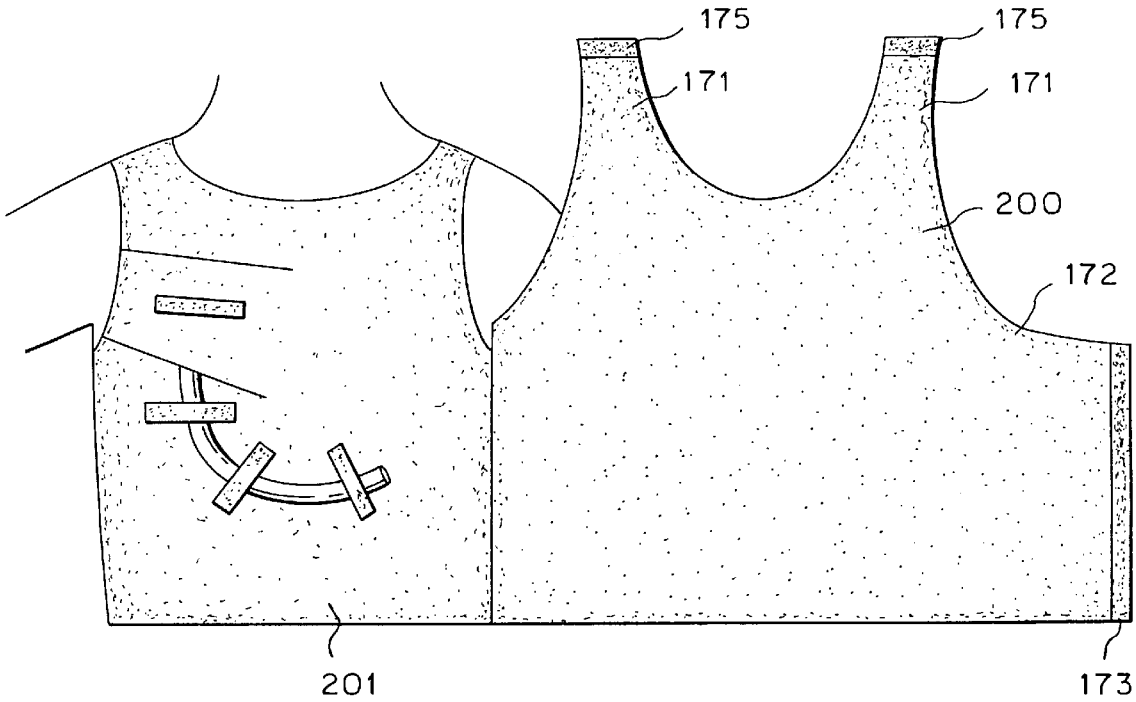
FIG. 2H shows a front view of the security garment of FIG. 2A with the protective cover in the open position.
Figure 2I:
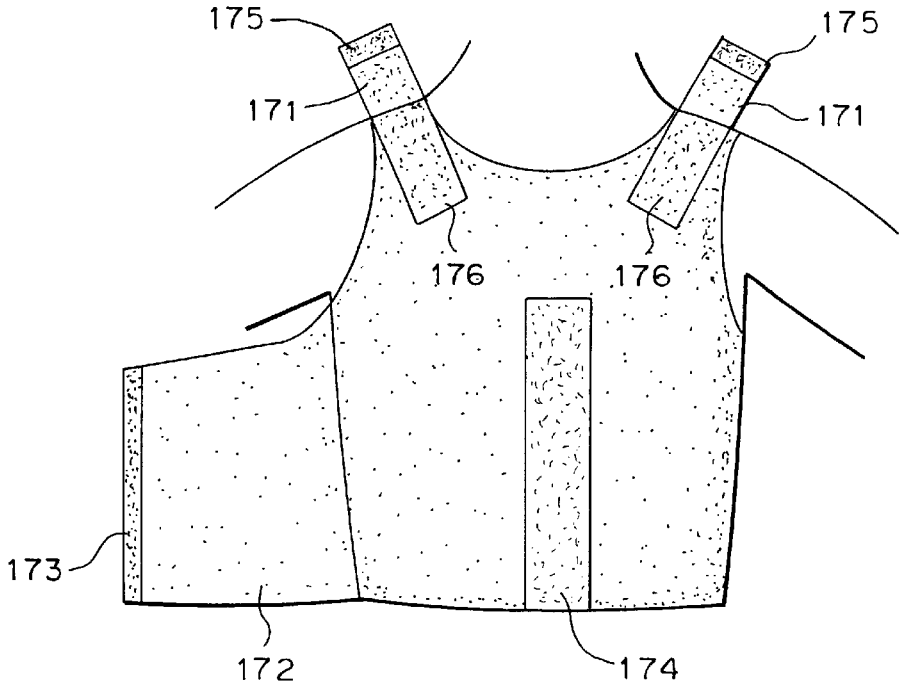
FIG. 2I shows a back view of FIG. 2G before the protective cover is fastened.
Figure 2J:
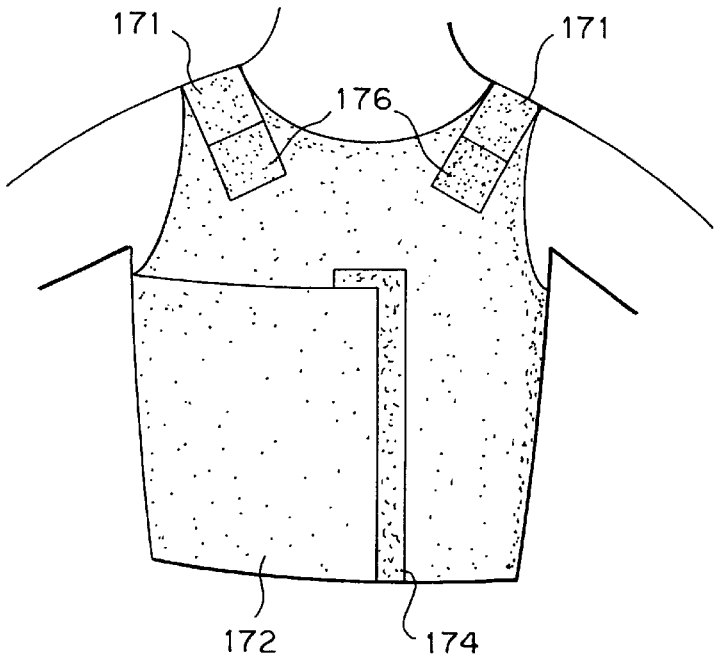
FIG. 2J shows a back view of FIG. 2G with the protective cover fastened.

FIG. 2H shows the security garment of FIG. 2G with the protective covering 200 open to reveal the security garment 201 underneath. The protective covering 200 fastens on the back of the security garment at the detachable, adjustable shoulder straps 171 and at the adjustable back closure 172. As shown in FIGS. 2H–2J, the back closure 172 may have hook fasteners 173 on the underside of the protective cover 200 that fasten to loop fasteners 174 attached to the back of the garment. The shoulder straps 171 of the cover also have hook fasteners 175 sewn on the underside of the shoulder straps that fasten to loop fasteners 176 sewn on the back of the shoulder.

Figure 2K:
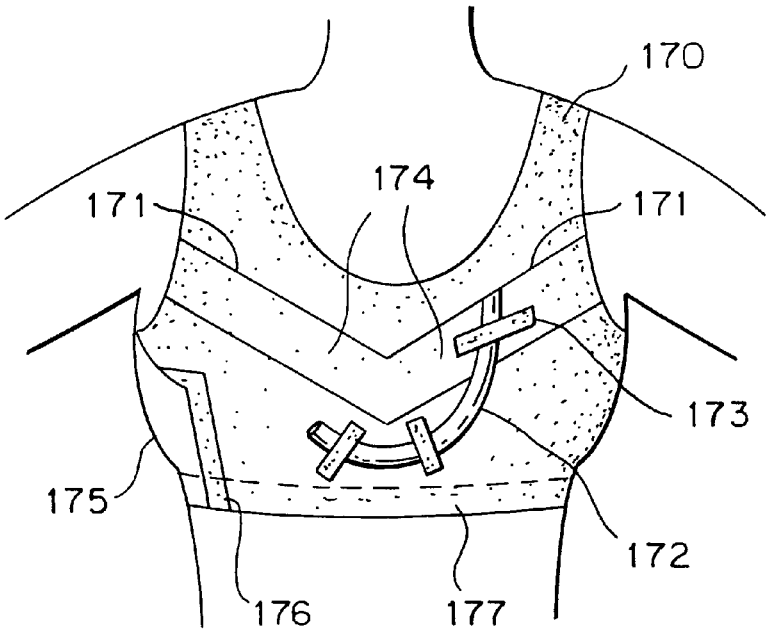
FIG. 2K shows a front view of the security garment in the form of a brassiere.

FIG. 2K shows a front view of the security garment shown in FIG. 2A in the form of a brassiere 170. Similarly, the security garments shown in FIGS. 2D–2E can also be made in the form of a brassiere. Slits or openings 171 can be placed on the front of the garment so that the tubing 172 can be threaded through the opening 171 and secured on the front of the garment with hook 173 and loop 174 fasteners and/or with pockets. The openings 171 can be lined with hook and loop fasteners (not shown). The garment has an adjustable side closure 175 which secures using hook (not shown) and loop 176 fasteners or any other fastening means. A soft, plush elastic band 177 provides support on the bottom of the brassiere.

Figure 2L:
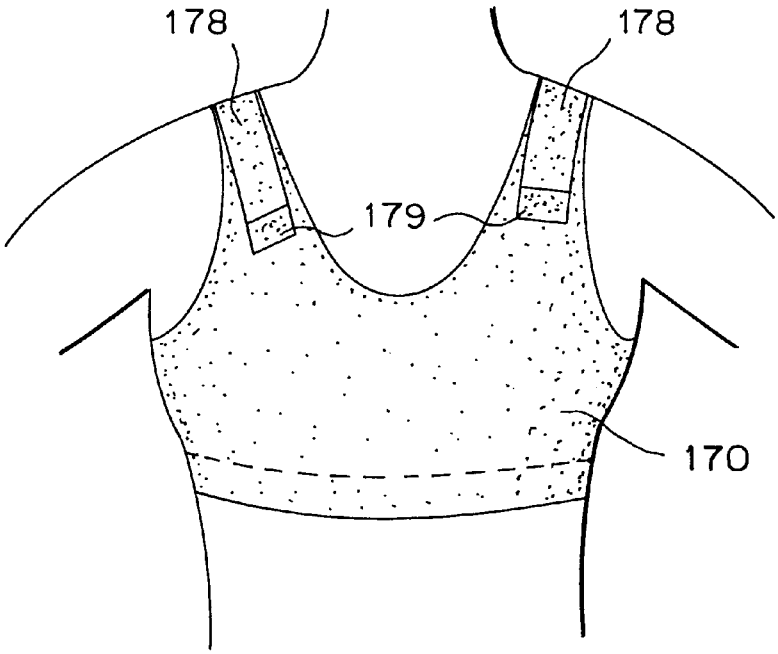
FIG. 2L shows a back view of the security garment of FIG. 2K.

FIGS. 2L show the back view of the security garment 170 of FIG. 2K with detachable adjustable shoulder straps 178. The straps 178 attach from the front of the security garment over the shoulders of the patient. Fastening means 179 are provided to anchor the straps to the back of the garment 170 by complementary fastening means on the straps (not shown).

Figure 3A:
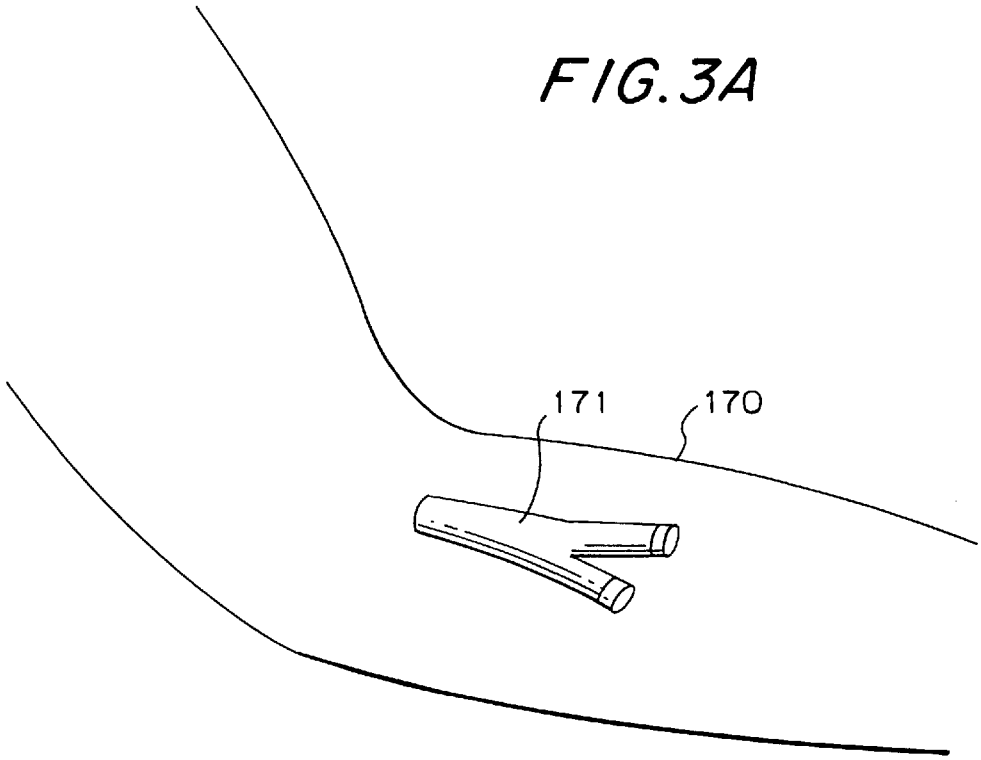
FIG. 3A shows an arm from which exits a peripherally inserted central catheter.

FIG. 3A illustrates an arm 170 from which exits a peripherally inserted catheter 171.

Figure 3B:
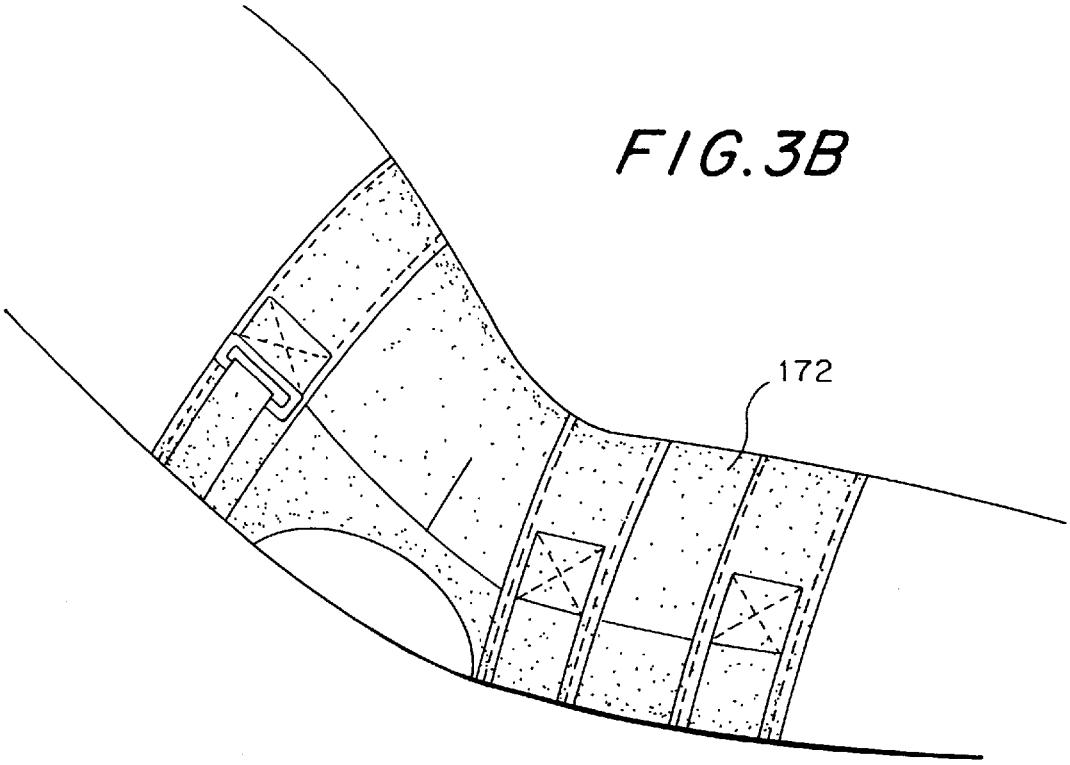
FIG. 3B shows a security sleeve for retaining a peripherally inserted central catheter which exits the arm above or below the elbow.
Figure 3C:
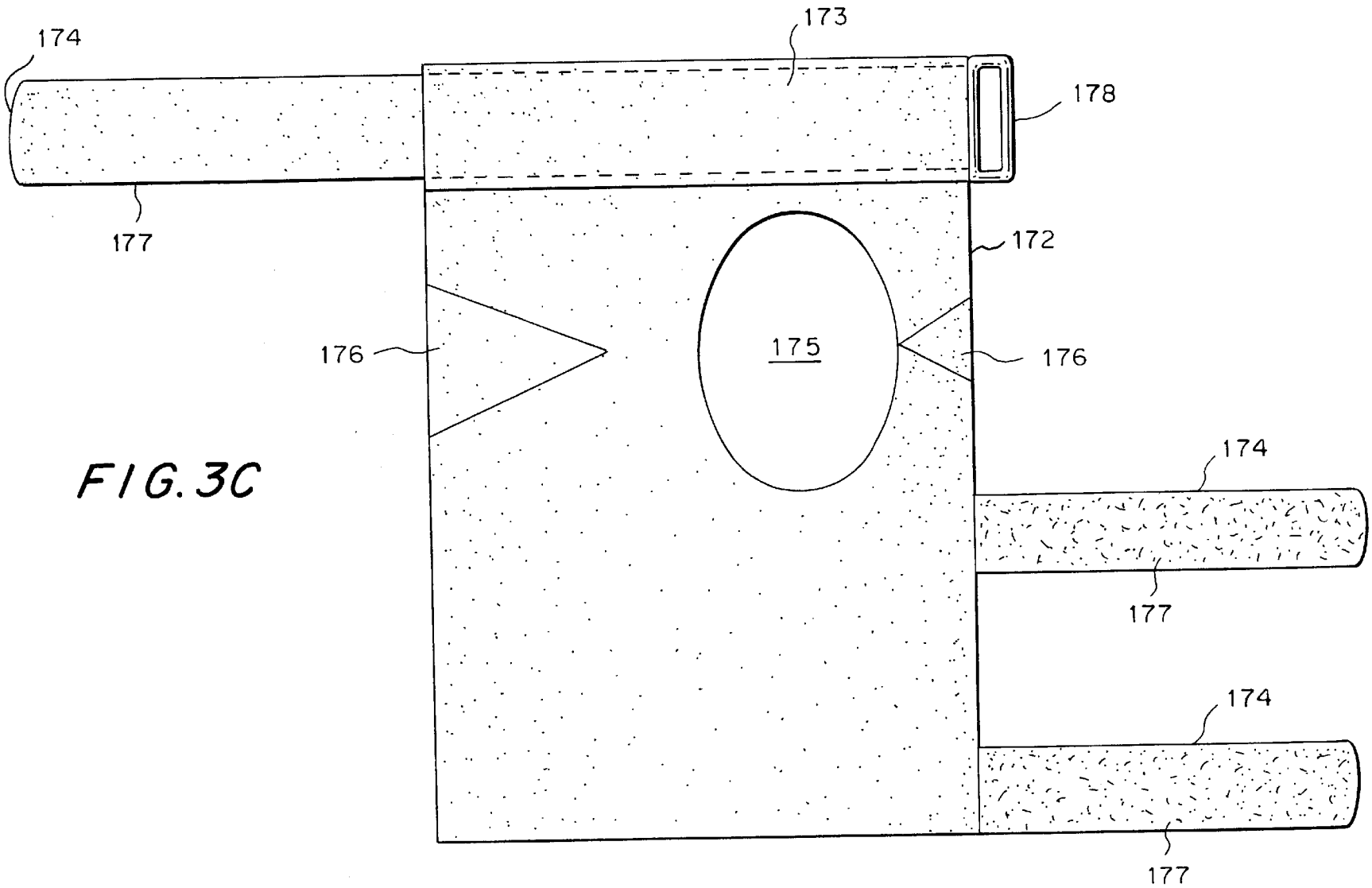
FIG. 3C shows a detailed drawing of the interior of the security sleeve 3B used for retaining a peripherally inserted central catheter which exits the arm above or below the elbow.
Figure 3D:
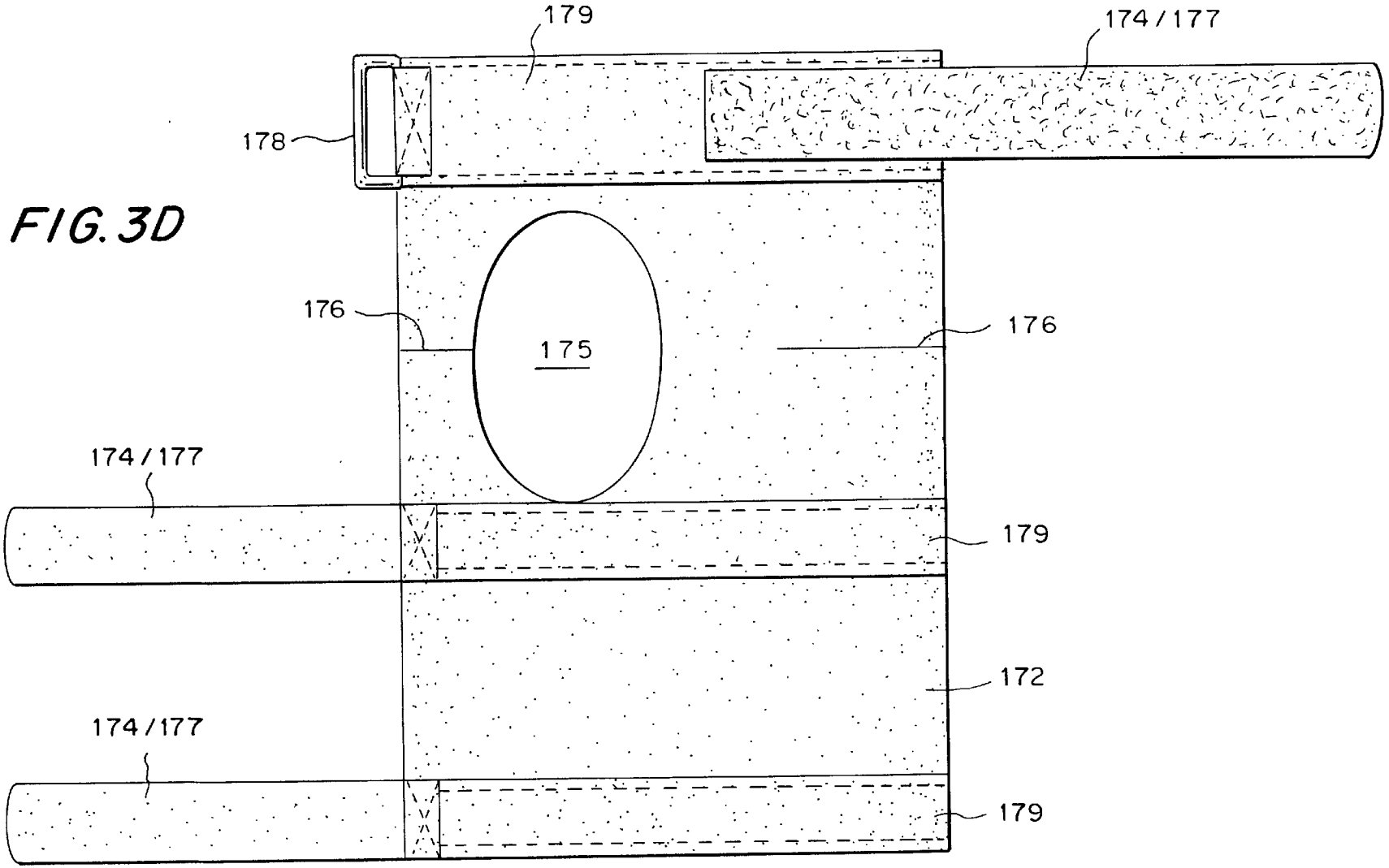
FIG. 3D shows a detailed drawing of the exterior of security sleeve 3B used for retaining peripherally inserted central catheter.

FIGS. 3B to 3D show sleeve-type security garments which are designed to secure and cover a peripherally inserted central catheter (PICC) line which may have a single lumen or multiple lumens, providing protection against dislodgement and perforation. This is especially important in the case of patients with PICC lines who use wheelchairs, as these lines can easily get caught in the spokes of the wheels if not properly secured. The sleeve-type security garments of the present invention eliminate the need for tape, thereby preventing skin irritation and potential infection from the breakdown of the skin caused by periodically removing the tape. The sleeve-type security garment permits easy accessibility to the PICC line for caregivers when administering infusion therapies and allows continuous infusion to be maintained while putting on and removing the security garment. In addition, the security sleeve protects the connection of the infusion tubing with the PICC line by covering the connection. The sleeve garment is made of materials such as cotton blends and laminates covered with soft loop material which are compatible with dressings recommended by the patient's health care professionals. The sleeve can be made infinitely adjustable with elastic loop fasteners, and can be machine washed and dried. This security garment is useful in increasing the peace of mind and quality of life for patients in whom PICC lines are implanted.

FIG. 3B shows a security sleeve 172 in place for retaining peripherally inserted catheters. The peripherally inserted central catheter line can be threaded through an opening above the elbow or below the elbow, depending upon the exit site.

FIG. 3C shows the interior of a security sleeve 172 which wraps around the catheter and covers the catheter. An opening 175 for the elbow allows easy articulation of the elbow and helps to keep the sleeve in place on the arm. Darts 176 made in the fabric also help to retain the sleeve in place. The sleeve 172 is retained in place on the arm using a combination of hook and loop fasteners or any other type of fasteners and plush elastic. The sleeve 172 is retained on the patient's arm with a band of plush elastic 173 which can be held in place by threading one end 174 of the band through a buckle 178, although other fastening means can also be used, including but not limited to hook and loop fasteners, resealable adhesives, hooks and eyes, and the like. Band 173 can be made of hook fasteners 177 on the underside that can be threaded through the buckle 178 and then attached to loop fasteners 179 on the top of the band shown in FIG. 3D.

FIG. 3D shows the outside of the sleeve 172 shown in FIG. 3C. To retain the sleeve on the arm, hook fasteners 177 on the elastic band 174 can be threaded through a buckle 178 and then attached to loop fasteners 179, although other fastening means can also be used. Similarly, hook fasteners can attach to loop fasteners 179 without using a buckle. The opening 175 for the elbow allows easy articulation of the elbow and helps to keep the sleeve in place on the arm. Darts 176 made in the fabric also help to retain the sleeve in place.

Figure 4A:
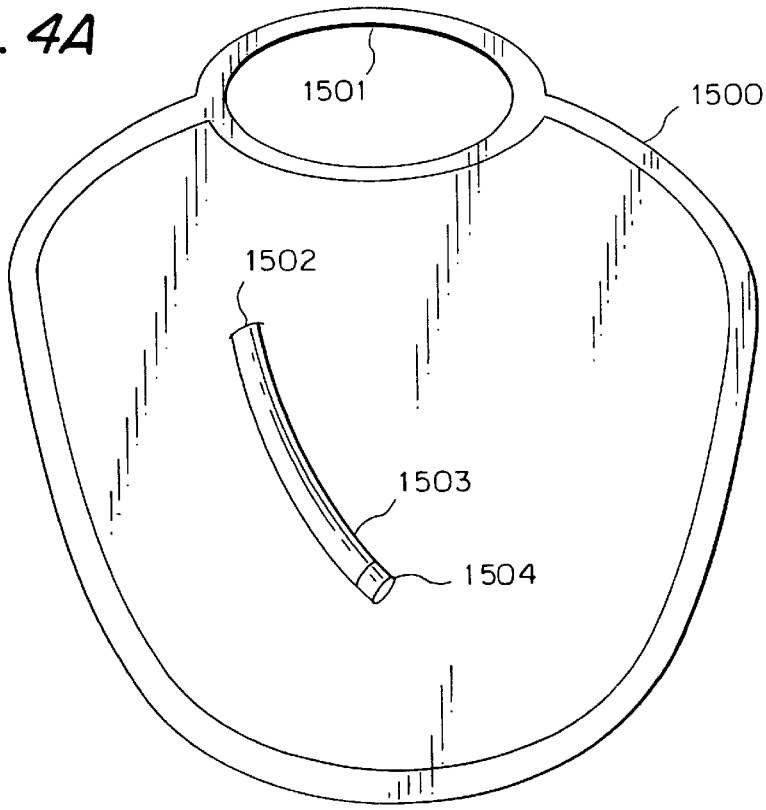
FIG. 4A shows a front view of an attached cover to a security garment for training in catheter care.
Figure 4B:
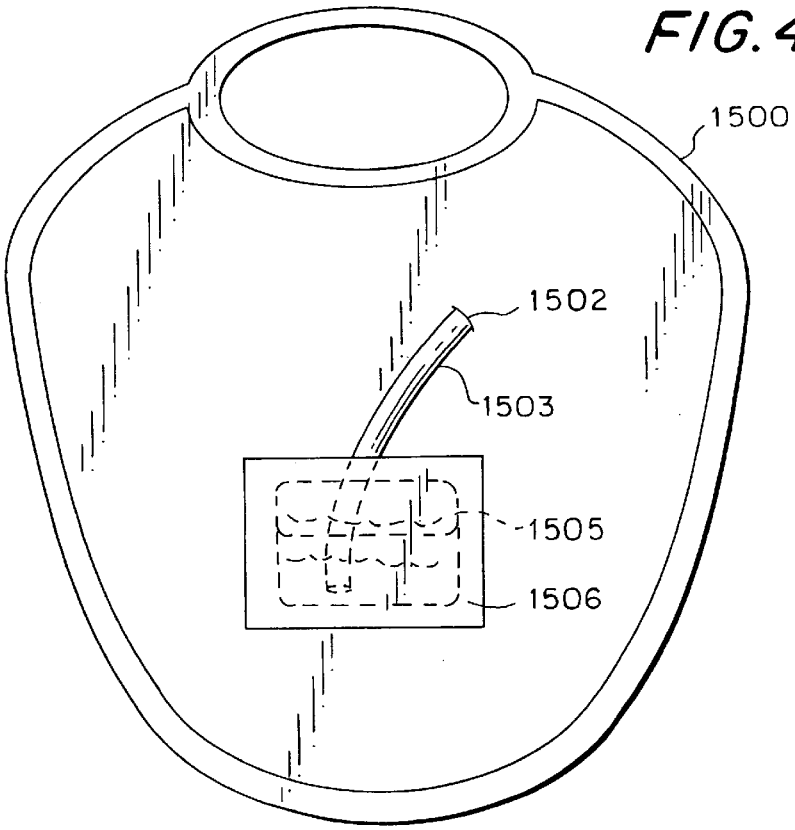
FIG. 4B shows a back view of the attachment of FIG. 4A.

FIG. 4A shows a front view, and FIG. 4B shows a back view, of an attachment 1500 for any of the security garments described above for use in training a patient or caregiver in the care of the catheter. The attachment 1500 is preferably made of nonporous, water-repellent or water-impermeable material. The attachment 1500 is secured around the patient's neck using any conventional type of fastener 1501 such as fabric strings, hook and loop fasteners, etc. A catheter 1503 is threaded through an opening or slits 1502 on the attachment, 1500 with the end of the catheter 1503 bearing a cap 1504 extending along the front of the attachment. The other end of the catheter tubing extends on the underside of the attachment, 1500 and its end is secured to a bag 1505 for draining, e.g., of an ostomy bag or a leg bag for a urinary Foley catheter. This bag is supported by a pocket 1506 on the underside of the catheter 1503.

The catheter security garment can be made of any comfortable fabric that is sufficiently strong to retain the catheter and/or feeding tube in place. The garment can be made of knit, woven or non-woven fabrics. A blend of cotton and Lycra®, is preferred because of its ability to fit closely around a patient's body while still being able to "breathe." Alternative fabric choices include cotton and cotton blends, synthetics such as polyester, polyamide, or blends thereof. Alternatively, a disposable catheter security garment can be made of non-woven cellulosic or woven or knitted natural or synthetic polymer fibers. A disposable garment can be made using a resealable adhesive in place of the hook and loop fasteners to keep the security garment and catheter in place.

The security garment of the present invention secures catheters and other tubes close to the body so that the tubing only minimally interferes with the patient's activities. The catheter is held in place so that there is neither vertical nor horizontal movement of the catheter. During the time that the security garment is worn, the catheter or other tube can be easily accessed for maintenance and administration of parenteral nutrition, blood products, chemotherapy, intravenous antibiotics, and the like. Any dressings on the catheter or other tubing can be easily changed while the patient is wearing the security garment of the present invention. Since the security garment is made of a thin, lightweight material, it can be worn inconspicuously under clothing. The garment can be made of a machine washable non-woven, woven, or knit fabric for easy laundering. For use with colostomy and ileostomy patients, as well as for young children, the security garment is provided with a protective or disposable covering for easy cleaning. Alternatively, disposable garments can be made of non-woven fabrics.

The security garment thus provides a reusable holder to support:

- telemetry units and pumps used to dispense intravenous medication through catheters;
- surgical drains;
- central venous catheters with exit sites on the chest or the back;
- catheter tubing inserted into subcutaneous implantable port devices for receiving infusion therapies;
- enteral nutrition feeding tubes, and
- peripherally inserted central catheters.

The security garment comes in a variety of styles, including an undershirt for children and adults, an undershirt with attached protective covering for infants and toddlers and people who have difficulty controlling their movements, and a sport-type bra for women and adolescent females.

The security garment of the present invention secures catheters of various lengths, including catheters which exit in the subclavicular area which tend to be shorter in length than other catheters. Current catheter types that are compatible with the security garment of the present invention include Hickman, Hohn, Broviac, and Groshong catheters.

The security garments can be designed to accommodate a variety of exit sites, including the subclavicular area, the thorax, the back, and limbs, including both arms and legs. All of the undershirt style garments can be reversed to accommodate catheters that have exit sites on the upper back of the patient.

The security garment supports catheters with single and multiple lumens. Additional pairs of straps for holding extra tubes and/or lumens can be provided on the security garment. Moreover, the security garment can support multiple catheters. For example, a patient may receive two double lumen central venous catheters in which one catheter has its exit site on the left side of the chest and a second catheter has an exit site on the right side of the chest. Openings and secured covers can be provided on both sides of the security garment to secure both catheters.

A security garment with additional features to support enteral nutrition feeding tubes can also support central venous catheters at the same time. For example, patients may remain on total parenteral nutrition which they receive through a central venous catheter, while starting to receive enteral nutrition through a feeding tube. With the additional features to support a feeding tube, the security garment is compatible with gastostomy tubes, jejunal tubes, and PEG tubes.

The security garment is compatible with continuous around-the-clock infusion because the garment can be put on and removed without disconnecting the catheter from the infusion tubing.

During infusions, the security garment helps prevent central venous catheters and infusion tubing from becoming tangled or kinked. This is especially important where the patient receives infusions while sleeping. Similarly, the security garment helps prevent feeding tubes from becoming tangled or kinked.

The security garment covers most central venous catheter exit sites. The security garment in the form of a sleeve can be adapted to cover peripherally inserted central catheters. The security garment helps prevent the person with the catheter from touching the exit site and/or dressing covering the site, thereby helping to decrease the potential for infection.

The security garment may eliminate the need for a bulky dressing over the catheter exit site. The secure fit of the security garment is made possible by its design, including its adjustable shoulder or waistband straps and side closure, and the use of fabric which has some stretchy properties, such as Lycra®, that enables the vest to hold gauze or dressings in place without the need for tape to secure the gauze or dressings.

Adjustable shoulder straps are provided using hook and loop fasteners, buttons, snaps, hooks and eyes, or reusable adhesive to give a secure fit. An adjustable side closure, like the adjustable shoulder straps, uses hook and loop fasteners, buttons, snaps, hooks and eyes, or reusable adhesive tape or the like to provide a secure fit while being adjustable to fit the wearer closely enough to retain the catheter in position while not being unduly confining. The wearer can adjust both the straps and the side closure for the most comfortable fit.

A combination security garment/sports bra supports both central venous catheters as well as breasts, eliminating the need to wear a separate bra and security garment.

The closure of the security garment can be made using hook and loop type fasteners. These fasteners impart some stiffness to the closure, which holds the garment in place and keeps it from riding up.

The shoulder straps of the security garment can be undone to allow access to the catheter exit site for dressing changes, examinations, etc.

For infants and toddlers with central venous catheters exiting on the front of the body, the shoulder straps and protective covering are fastened on the back of the garment beyond the reach of the child's hands. The protective covering on the infant and toddler garments helps prevent children from touching and disengaging the connection of the catheter with the infusion tubing. Similarly, the protective flap on the security garment that covers the feeding tube may help prevent the disengagements and touching of the tubing connection.

The security garment provides additional comfort for the patient. The vest provides a buffer of soft cloth between the catheter clamps and the patient's skin, reducing the discomfort caused by clamps pressing against the skin. There is no need to use tape to secure the catheter. Eliminating the requirement for tape reduces the possible allergic reactions and skin irritations caused by tape, as well as skin infections caused by tape burns.

The security garment helps prevent dislodgement of catheters and feeding tubes. This reduces the need for replacing and/or resuturing catheters and feeding tubes that may require surgery. Perforation of catheters and feeding tubes is also prevented by the security garment, in that the catheters and tubes are secured under clothing where they are better protected. In the case of security garments for infants and toddlers, a protective covering over the garment provides additional protection for the catheter or feeding tube. This may prevent infants and toddlers from biting the catheter, which may result in an infection in the line.

The security garment can be worn inconspicuously under clothing at all times. The security garment for infants and toddlers may be worn as a sleeveless top. The protective covering of the infant and toddler security garment can have an applique or design (e.g., cartoon character) placed on the front which may result in some psychological benefit to the children, family, and/or caregiver.

The security garment can be made of any of a variety of materials. A preferred material is a blend of cotton and Lycra®, which is machine washable and dryable, durable, and retains its shape over the life of the garment.

The security garment has an optional attachment that can be used to train the patient or the patient's caregiver in procedures to be done at home, including:

cleaning the exit site;

applying a dressing over the exit site;

flushing the catheter with, for example, a saline solution;

changing the catheter caps; and learning to manage infusion therapies, e.g., how to hook up caps for infusion therapies.

This training ultimately decreases the risk of infection and dislodgement of the catheter and the need for additional home nursing care.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention. Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same function can be used; and it is intended that such expressions be given their broadest interpretation.

What is claimed is:

1. A security garment comprising an outer shell and an inside layer;

said outer shell configured in the shape of a garment to cover at least an upper torso of a wearer's body, said outer shell having an inside and an outside, a front and a back, and a top and bottom;

fastening means attached to the inside of the front of said outer shell;

said inside layer comprising a band which extends across the front of the wearer's body, said band comprising an inner layer, an outer layer, a front and a back;

said outer layer of the band being provided with fastening means to secure said outer layer to the inner layer of the band;

the front of said band comprising fastening means to secure a catheter or tubing exiting the wearer's body so as to prevent both horizontal and vertical movement of said catheter or tubing.

2. A security garment according to claim 1, wherein said band includes a pocket.

3. A security garment according to claim 1, wherein said outer shell of said garment is in the shape of a vest.

4. A security garment according to claim 1, wherein said outer shell of said garment has sleeves.

5. A security garment according to claim 1, wherein the inner layer of said band is provided with binding.

6. A security garment according to claim 1, wherein the fastening means are hook and loop closures.

7. A security garment according to claim 1, wherein the outer shell includes detachable, adjustable shoulder straps.

8. A security garment according to claim 1, which includes closure means on a side of the garment.

9. A security garment according to claim 1, which includes closure means at the back of the garment.

10. A security garment according to claim 1, wherein the inner layer of the band is used to create a tension loop in the catheter or tubing.

11. A security garment according to claim 1, wherein the band is provided under the outer layer of the garment, said band being adapted to support an electrocardiograph unit, and fastening means to retain the band in attachment to the garment's outer layer.

12. A security garment according to claim 1, further including a detachable strap attached to the bottom of the outer layer of the outer shell.

13. The security garment according to claim 1, further comprising a sleeve that covers at least one peripherally inserted central catheter line exiting the wearer's body;

fastening means on said sleeve for retaining said at least one catheter line in place to prevent its horizontal and vertical movement; and adjustable fastening means to retain the sleeve in place on the arm of the wearer.

14. The security garment according to claim 1, which is made at least in part of water-repellant material.

15. A security garment comprising an undershirt having at least one opening, said security garment having an inside and an outside, a front and a back;

at least one opening for tubing for at least one catheter such that tubing or catheters exiting the body of the wearer are threaded through said at least one opening;

fastening means on the front of said garment to retain said tubing or at least one catheter in place and to prevent its movement in either the horizontal or vertical direction;

and detachable, adjustable shoulder straps on the outer shell of said garment.

16. A security garment according to claim 15, further comprising a protective cover attached thereto.

17. A security garment according to claim 15, wherein the opening begins at an armhole of the security garment.

18. A security garment according to claim 15, wherein the opening begins at a neckline of the security garment.

19. A security garment according to claim 15, wherein the opening begins at the garment's shoulder straps.

20. A security garment according to claim 15, wherein the opening begins at a hem of the security garment.

21. A security garment according to claim 15, wherein said at least one opening is lined with fastening means.

22. A security garment according to claim 15, having an adjustable side closure.

23. A security garment according to claim 15, having a back closure.

* * * * *